US011380497B2

(12) United States Patent
Treger et al.

(10) Patent No.: US 11,380,497 B2
(45) Date of Patent: Jul. 5, 2022

(54) ROTARY KNOB MECHANICAL ENCODER

(71) Applicant: August Home, Inc., San Francisco, CA (US)

(72) Inventors: Aaron Treger, Pinole, CA (US); Colin Parker, San Francisco, CA (US); Darius Yu, Fremont, CA (US)

(73) Assignee: August Home, Inc., San Francisco, CA (US)

( * ) Notice: Subject to any disclaimer, the term of this patent is extended or adjusted under 35 U.S.C. 154(b) by 62 days.

(21) Appl. No.: 16/837,440

(22) Filed: Apr. 1, 2020

(65) Prior Publication Data

US 2020/0328051 A1 Oct. 15, 2020

Related U.S. Application Data

(60) Provisional application No. 62/830,205, filed on Apr. 5, 2019.

(51) Int. Cl.
*H01H 19/00* (2006.01)
*H01H 19/14* (2006.01)
(Continued)

(52) U.S. Cl.
CPC ..... *H01H 19/005* (2013.01); *E05B 1/0007* (2013.01); *H01H 19/14* (2013.01); *E05B 47/0012* (2013.01); *E05B 2047/0048* (2013.01); *E05B 2047/0069* (2013.01); *E05B 2047/0091* (2013.01)

(58) Field of Classification Search
CPC .... H01H 19/005; H01H 19/14; H01H 19/585; H01H 19/03; H01H 19/10; H01H 19/54; H01H 19/56; H01H 19/566; H01H 19/58; H01H 3/08; H01H 2201/004; H01H 2205/002; H01H 2203/018; H01H 19/00; E05B 1/0007; E05B 47/0012; E05B 2047/0048; E05B 2047/0069;
(Continued)

(56) References Cited

U.S. PATENT DOCUMENTS 6,864,440 B2 * 3/2005 Kim ..... H01H 19/585 200/11 R
8,975,543 B2 * 3/2015 Hakemeyer ..... H01H 19/585 200/11 TW (Continued)

*Primary Examiner* — Lheiren Mae A Caroc
(74) *Attorney, Agent, or Firm* — Wolf, Greenfield & Sacks, P.C.

(57) ABSTRACT

A rotary knob for operating an electronically actuable deadbolt is described herein. According to some embodiments, the rotary knob includes a chassis, an outer wall rotatably coupled to the chassis about a central axis of the knob, a cantilevered beam attached to an inner surface of the outer wall and extending towards the central axis of the knob such that the beam is configured to rotate with the outer wall about the central axis, a circuit board coupled to the chassis, the circuit board including signal traces, and an electrical contact extending from the cantilevered beam in a direction toward the signal traces and electrically connectable with the signal traces. A controller of the rotary knob is configured to determine a position of the deadbolt based on at least the state of the electrical connection between the electrical contact and the signal traces.

21 Claims, 14 Drawing Sheets

(51) Int. Cl.
*E05B 1/00* (2006.01)
*E05B 47/00* (2006.01)

(58) Field of Classification Search
CPC .. E05B 2047/0091; E05B 47/023; E05B 1/00; E05B 47/00
See application file for complete search history.

(56) References Cited

U.S. PATENT DOCUMENTS

| | | | |
|---|---|---|---|
| 9,140,035 | B2 | 9/2015 | McKibben et al. |
| 9,528,296 | B1 | 12/2016 | Cheng et al. |
| 2013/0219975 | A1 | 8/2013 | Ainley et al. |
| 2019/0226827 | A1 | 7/2019 | Caterino et al. |

* cited by examiner

ROTARY KNOB MECHANICAL ENCODER

RELATED APPLICATIONS

This application claims the benefit under 35 U.S.C. § 119(e) to U.S. Provisional Application Ser. No. 62/830,205, filed Apr. 5, 2019, titled "ROTARY KNOB MECHANICAL ENCODER", which is herein incorporated by reference in its entirety.

FIELD

Disclosed embodiments are related to electromechanical door lock systems.

BACKGROUND

Deadbolt locks can be used to secure doors to prevent unauthorized entry. Some deadbolt locks can be operated by a knob or thumb-turn mounted on the secured side of the door, and by a key-turn on the unsecured side of the door. For these deadbolt locks, rotation of the knob extends or retracts a deadbolt into or out of an associated jamb adjacent to the entranceway. Some deadbolts may further be electromechanically actuatable in addition to being manually actuatable. Such electromechanical deadbolts further include a motor that may extend or retract the bolt.

SUMMARY

According to some embodiments, a rotary knob for operating an electronically actuatable deadbolt may include a chassis with an outer wall rotatably coupled to the chassis. The outer wall may rotate about a central axis of the knob. A cantilevered beam may be attached to an inner surface of the outer wall and may extend towards the central axis of the knob such that the beam is configured to rotate with the outer wall about the central axis. A circuit board, including a first signal trace, may be coupled to the chassis. An electrical contact that is electrically connectable with the first signal trace may extend from the cantilevered beam in a direction toward the first signal trace.

It should be appreciated that the foregoing concepts, and additional concepts discussed below, may be arranged in any suitable combination, as the present disclosure is not limited in this respect. Further, other advantages and novel features of the present disclosure will become apparent from the following detailed description of various non-limiting embodiments when considered in conjunction with the accompanying figures.

BRIEF DESCRIPTION OF DRAWINGS

The accompanying drawings are not intended to be drawn to scale. In the drawings, each identical or nearly identical component that is illustrated in various figures may be represented by a like numeral. For purposes of clarity, not every component may be labeled in every drawing. In the drawings.

DETAILED DESCRIPTION

Figure 1A:
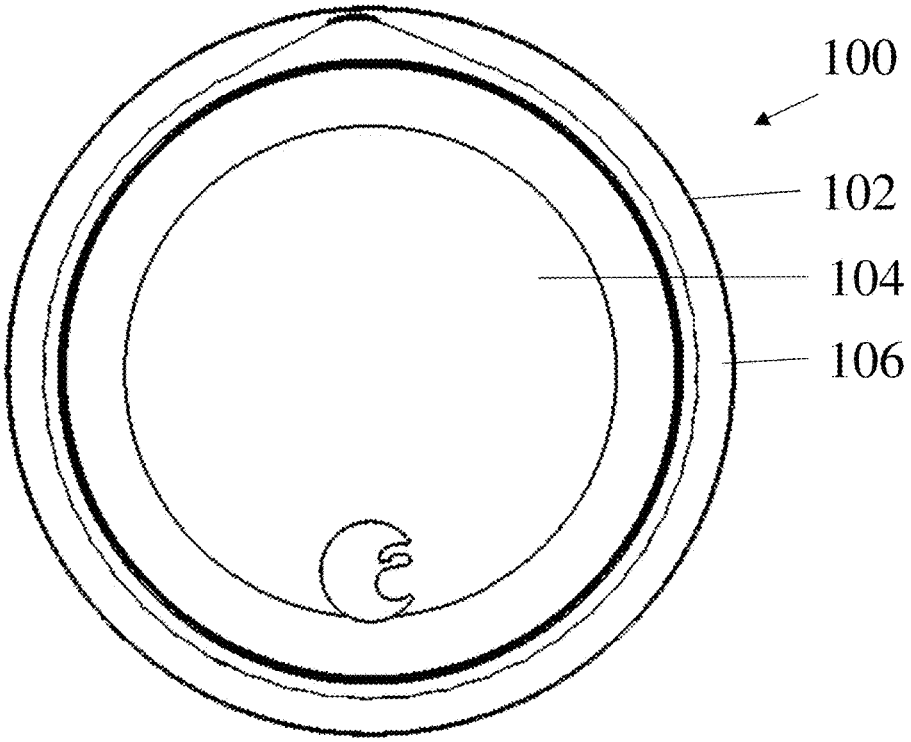
FIG. 1A is a front view of a rotary knob according to one embodiment.
Figure 1B:
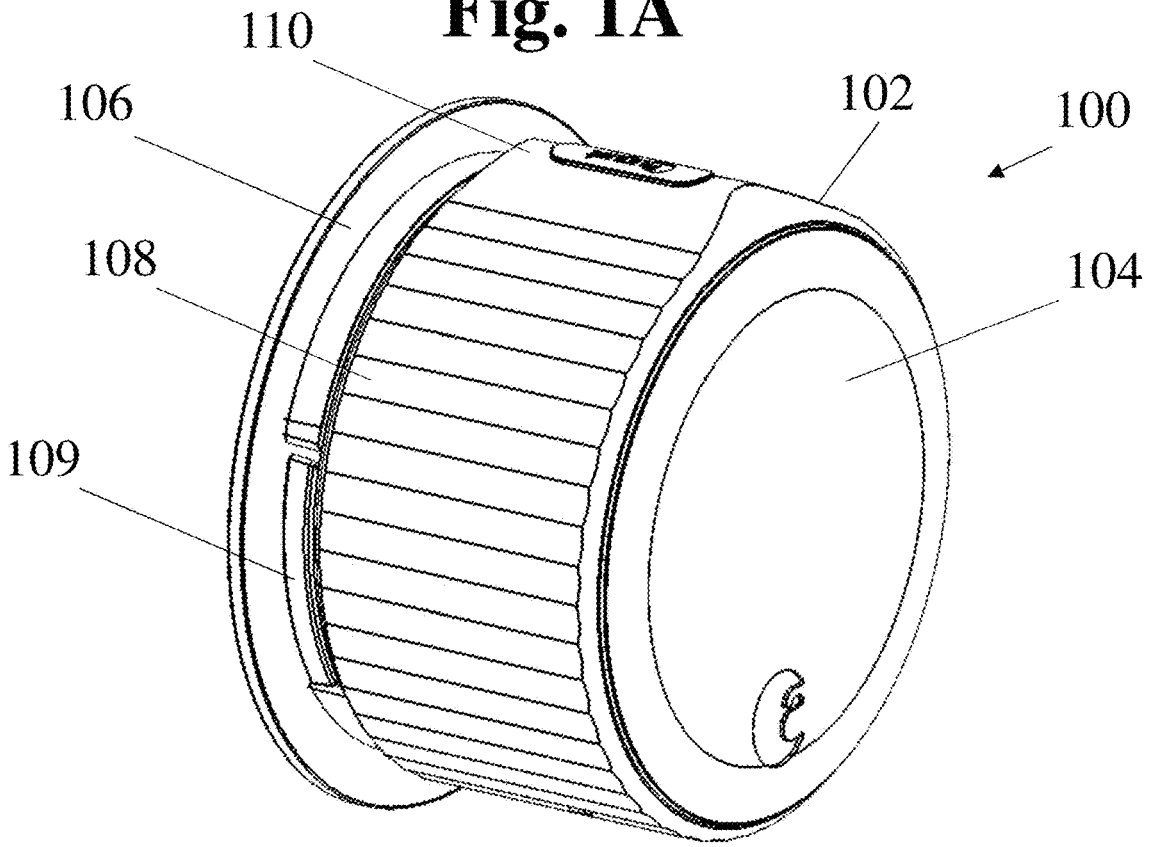
FIG. 1B is a front, left, perspective view of the rotary knob of FIG. 1A.

It should be understood that aspects are described herein with reference to certain illustrative embodiments and the figures. The illustrative embodiments described herein are not necessarily intended to show all aspects, but rather are used to describe a few illustrative embodiments. Thus, aspects are not intended to be construed narrowly in view of the illustrative embodiments. In addition, it should be understood that certain features disclosed herein might be used alone or in any suitable combination with other features.

As well known in the art, deadbolt locks (also referred to simply as deadbolts) comprise a bolt that is disposed at least partially within a door in a retracted/unlocked position, and extends out from the door, into a door jamb, in an extended/locked position. The physical presence of the bolt extending from within the door into the door jamb prevents the door from being opened by blocking the door from being swung out of the door frame.

With the increasing adoption of home automation features, it is becoming more common for deadbolts to be actuable between the locked and unlocked positions by a remotely and/or automatically triggered motor. However, some users may wish to circumvent the remote features for various reasons and instead manually lock and unlock the deadbolt using a physical knob to actuate the bolt. Many electromechanically actuated deadbolts available on the market include features that allow manual operation of the bolt in addition to motor driven actuation of the bolt.

The inventors have previously contemplated that it would be desirable to have a rotary knob that includes and adds electromechanical drive capabilities for an associated deadbolt, that is also retrofittable to existing lock sets so consumers who desire remote or automatic actuation capabilities could add such capabilities without extensive modification of their existing doors. One example of such a rotary knob may be described in U.S. Pat. No. 9,528,296. Such rotary knobs can often be rotated to directly drive the bolt, while also including a motor and clutch mechanism for non-manual actuation of the bolt.

The inventors have recognized that it may be desirable to provide accurate reporting of the rotational position of the knob for a deadbolt that is actuated both manually and automatically. With the inclusion of manual driving of the bolt via the knob, the bolt is not constrained to only predefined rotation increments otherwise caused by the motor. With knowledge of the position of the knob, a controller of the knob may be configured to calculate the amount of time required to operate the motor at certain output speeds of the motor in order for the bolt to reach a locked or unlocked state based on the existing rotational position of the knob. Such calculations would prevent over-driving or under-driving the bolt that may otherwise lead to damage of the locking mechanism or incorrect beliefs about the locked/unlocked state of the door, respectively.

According to one embodiment, the rotary knob may include an adaptor that may allow the knob to operatively couple to a cam shaft of an existing deadbolt. It is contemplated that coupling the knob to an existing deadbolt may allow a user to replace an existing manual knob or thumbturn with the rotary knob, thereby retrofitting their existing lock. The knob may be gripped and rotated to rotate the cam shaft and drive the bolt.

In some embodiments, instead of only allowing a user to manually rotate the knob to drive the bolt, actuation of the bolt may be remotely triggered by a user, or automatically triggered by a predetermined event. In these embodiments, the rotary knob may further include a motor that may be remotely or automatically triggerable by a controller built into the knob to rotate the cam shaft and drive the bolt.

In some embodiments, the rotary knob may include a chassis with an outer wall. The outer wall may act as a dial that may be rotated relative to both the door and various fixed components of the knob housed within the chassis. A cantilevered beam may be fixed to the inner surface of an outer wall of the chassis. As the knob is rotated, the outer wall may rotate relative to a central axis of the rotary knob, causing the cantilevered beam to also rotate about the central axis of the rotary knob. The cantilevered beam may rotate relative to a circuit board of the knob that is fixed within the chassis.

A circuit board may be housed within the chassis according to some embodiments of the rotary knob. In these embodiments, an electrical contact may extend from the cantilevered beam towards the circuit board and a signal trace located on the circuit board.

In some embodiments, as the cantilevered beam may rotate relative to the circuit board. As the cantilevered beam rotates about the circuit board, the electrical contact may make electrical contact with a signal trace of the circuit board at certain positions of the possible range of rotational positions. The circuit board and signal trace may be configured such that the controller is alerted to the state of an electrical connection between a signal trace and the electrical contact when an electrical connection is made between the signal trace and the electrical contact.

In some embodiments, the signal trace may include a plurality of signal traces. In these embodiments, the electrical contact may make contact with multiple signal traces of the plurality of signal traces at different positions of the possible range of rotational positions. In each position, the electrical contact may be contacting one or more of the signal traces. In these embodiments, the circuit board and signal traces may be configured such that the controller is alerted to which of the signal traces are in contact with the electrical contact.

In some embodiments, the first signal trace or each of the plurality of signal traces may be arranged in arcs concentrically arranged about the central axis of the rotary knob. The arcs may be in the same plane, or may be in different planes separated in one or more dimensions. In some embodiments, multiple signal traces may be arranged continuously or discontinuously across a single arc, or single signal traces with intermittent breaks or gaps may be arranged continuously across single arcs. In other embodiments, the signal traces may be arranged in continuous or discontinuous linear or non-linear segments that may or may not be arranged in shapes or patterns on the circuit board.

In some embodiments, the state of electrical contact between the electrical contact and one or more signal traces may inform the controller of the rotational position of the cantilevered beam and outer wall. Using the positions of the cantilevered beam and outer wall, the controller may determine the position of the bolt, which is driven at a predetermined ratio by rotation of the outer wall. In some embodiments, the concentric arcs of signal traces may be divided into imaginary sectors corresponding to rotational positions of the outer wall. In these embodiments, as the outer wall rotates, the cantilevered beam rotates across sectors. While the beam is within a sector, the electrical contact may simultaneously make contact with each of the signal traces present in the sector. The signal traces may be distributed and arranged across the sectors such that the electrical contact may electrically connect with a unique combination of signal traces in each sector. Based on the combination of signal traces connected at any given moment, the controller may determine which sector the beam is currently within, thereby determining the rotational position of the knob. As such, the arrangement and detection of the signal traces may function as a position encoder for the rotary knob.

In some embodiments, as with signal traces that are discontinuous, specific combinations of such discontinuous signal traces may correspond to a specific rotational position or a specific range of rotational positions. For example, a location of the discontinuity along a first trace may be different from location of the discontinuity along a second trace such that the electrical contact will connect to different combinations of portions of the traces in different rotational positions. When the controller detects a certain combination of signal traces, the controller may match the detected combination to one of the saved combinations to determine that the knob is in the rotary position corresponding to the matched combination. In other embodiments, a Gray Code like system may be implemented. As would be appreciated by one of skill in the art, a Gray Code system may be implemented where each signal trace being present or not present may be interpreted by the controller as a single bit, with the full complement of signal traces being present or not present corresponding to a binary value or bit pattern. Adjacent sectors may differ by only a single bit, allowing the controller to easily determine the rotational position of the beam and knob and track the history of movement without significant computational complexity.

According to some embodiments of the rotary knob, the electrical contact may include one or more leaf springs configured to elastically deform when in contact with the signal traces. In these embodiments, the electrical contact may include a base plate attached to the cantilevered beam. The leaf springs of the electrical contact may include a plurality of members that may extend from one end of the base plate, bending out of the plane of the base plate, towards the circuit board and signal traces. In this respect, the leaf spring may form a hairpin bend such that the ends of the members extend back towards the base plate, out of the plane of the base plate. The ends of the members may be curved or hooked to improve contact with the signal traces. In these embodiments, as the cantilevered beam rotates across the signal traces, the hooked ends of the leaf springs contacting the signal traces are pressed against the signal trace, elastically deforming the leaf springs towards the base plate of the electrical member. This deformation may cause the leaf springs to exert additional force in the direction of the signal traces, improving electrical conduction between the signal traces and the leaf springs of the electrical contacts.

In some embodiments, the ends of the leaf springs may divide into one of more prongs, each with a hooked end. Such a multi-pronged configuration provides redundant contact points for the signal trace for improved reliability. In some embodiments, the signal traces may protrude from the plane of the circuit board towards the cantilevered beam to further improve electrical connection between signal traces and the electrical contact. In some embodiments, the electrical contact includes one leaf spring for each arc of signal traces such that one leaf spring contacts each signal trace along its corresponding arc as the cantilevered beam rotates across. In other embodiments, multiple leaf springs may correspond to a single arc, or multiple prongs of a single leaf spring may correspond to more than one arc.

In some embodiments, the rotational range of the knob is constrained to match the possible range of movement of the bolt between the retracted and extended positions. Preventing the rotary knob from being rotated beyond the corresponding possible range of movement of the bolt may prevent damage to the locking mechanism. In these embodiments, the knob may include stoppers located within the chassis that remain stationary relative to the rotatable outer wall and cantilevered beam. The one, two, or more stoppers may be positioned at the extremes of the desired rotational range of the outer wall such that the cantilevered beam physically bumps into the stoppers at the ends of the rotational range, preventing the knob from being rotated any further. In some embodiments, the stoppers may be positioned at or near diametrically opposite ends of the knob with the outer edges of the stopper defining the boundaries of the rotational range of the knob. In these embodiments, the edge of the cantilevered beam physically bumps into the outer edge of a stopper at the end of the desired rotational range.

In some embodiments, the cantilevered beam may flare laterally at the fixed end of the cantilevered beam. The flared sides and the edges of the beam may be shaped such that, at the extremes of the rotational range of the knob, the lateral surface of the flared ends at least partially wrap around the stopper to ensure the closest possible fit between the cantilevered beam and the stoppers. In some embodiments, the stoppers may surround screw holes located at diametric ends of the chassis.

It is contemplated that the rotary knob may be retrofitted over a variety of existing door locks which may include a variety of differently shaped and sized cam shafts. In view of this, the rotary knob may include a variety of removable adaptors, each with a differently shaped slot designed to receive a different shape of cam shaft. In some embodiments, the free-end of the cantilevered beam ends in a central portion, where the central portion may be at least partially hollow to receive an adaptor. In some embodiments, the central portion may be cylindrical and coaxial with the central axis of the knob. In these embodiments, an adaptor end of the central portion acts as a socket that receives and retains at least part of the adaptor. The free-end of the cantilevered beam is connected to an adaptor end of the central portion, which may be capable of rotating about the central axis along with the cantilevered beam and outer wall, allowing rotation of the knob to rotate the adaptor and cam shaft to drive the bolt. At least parts of the exterior edge of the adaptors may include interlocking features that may interlock with reciprocal interlocking features on the inside of the adaptor end of the central portion.

It is contemplated that a system that allows actuating the cam shaft of a deadbolt with rotation through both manual operation and motor operation may also allow manual driving of the cam shaft that may back-drive the motor. In some embodiments of the knob, the central portion may include a drive end opposing the adaptor end of the central portion. The drive end may at least partially contain a drive cam, which may in turn operably connected to the shaft of the motor. The drive cam may include one or more wings that extend from the circumference of the drive shaft. The inner surface of the drive end may include protrusions that project from the inner surface of the drive end towards the drive cam. As the motor rotates the motor shaft, the drive cam is rotated until the wings contact the protrusions. At that point, continued activity from the motor may cause the wings to push against the protrusions, causing the rotation to the adaptor end of the central portion, thereby rotating both the knob and the cam shaft and actuating the bolt. The drive end may be designed such that the protrusions are positioned to allow the drive end to rotate with the outer wall along its entire rotational range without contacting the wings of the drive cam. Such an arrangement may allow the cam shaft to be rotatable manually via the knob across the full rotation range without causing the drive cam to rotate. It is contemplated that such an arrangement decoupling rotation of the knob from rotation by the motor may reduce the risk of back-driving and damaging the motor.

Turning to the figures, specific non-limiting embodiments are described in further detail. It should be understood that the various systems, components, features, and methods described relative to these embodiments may be used either individually and/or in any desired combination as the disclosure is not limited to only the specific embodiments described herein.

FIGS. 1A-1D show the rotary knob according to one embodiment. The circuit board, cantilevered beam, and other non-housing components of the knob may be located within the chassis 102 of the knob. The chassis 102 may be covered at the front by a front cover 104. The outer surface 108 of the outer wall of the knob may define the circumference of rotary knob 100. As will be described below, portions of the chassis 102, including the outer wall and front cover 104 may be rotated relative to the mounting plate 106 and various internal components of the knob within the chassis 102. Orientation indicator 110 protrudes from the outer surface 108 of the outer wall, providing for the user a point of reference when trying to gauge how far the knob has been rotated. Mounting plate 106 acts both as the rear cover of the knob, as well as part of the mounting mechanism to attach the knob to a door.

Figure 1C:
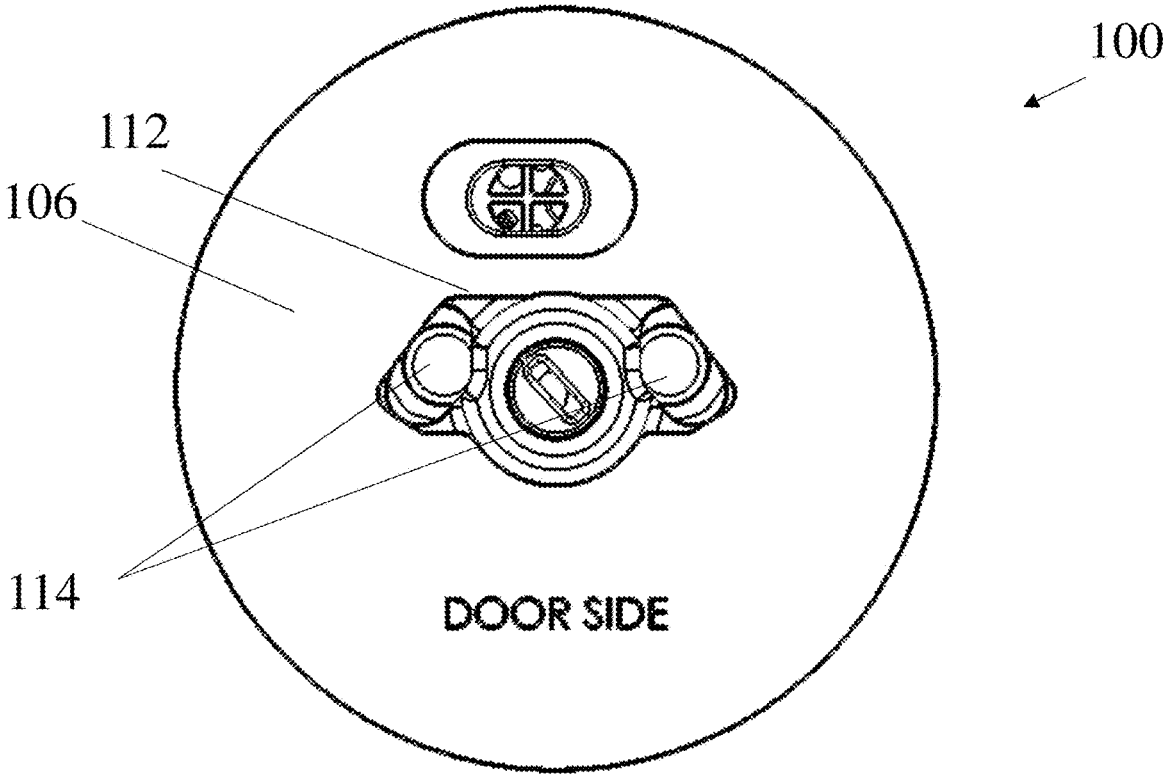
FIG. 1C is a rear view of the rotary knob of FIG. 1A.
Figure 1D:
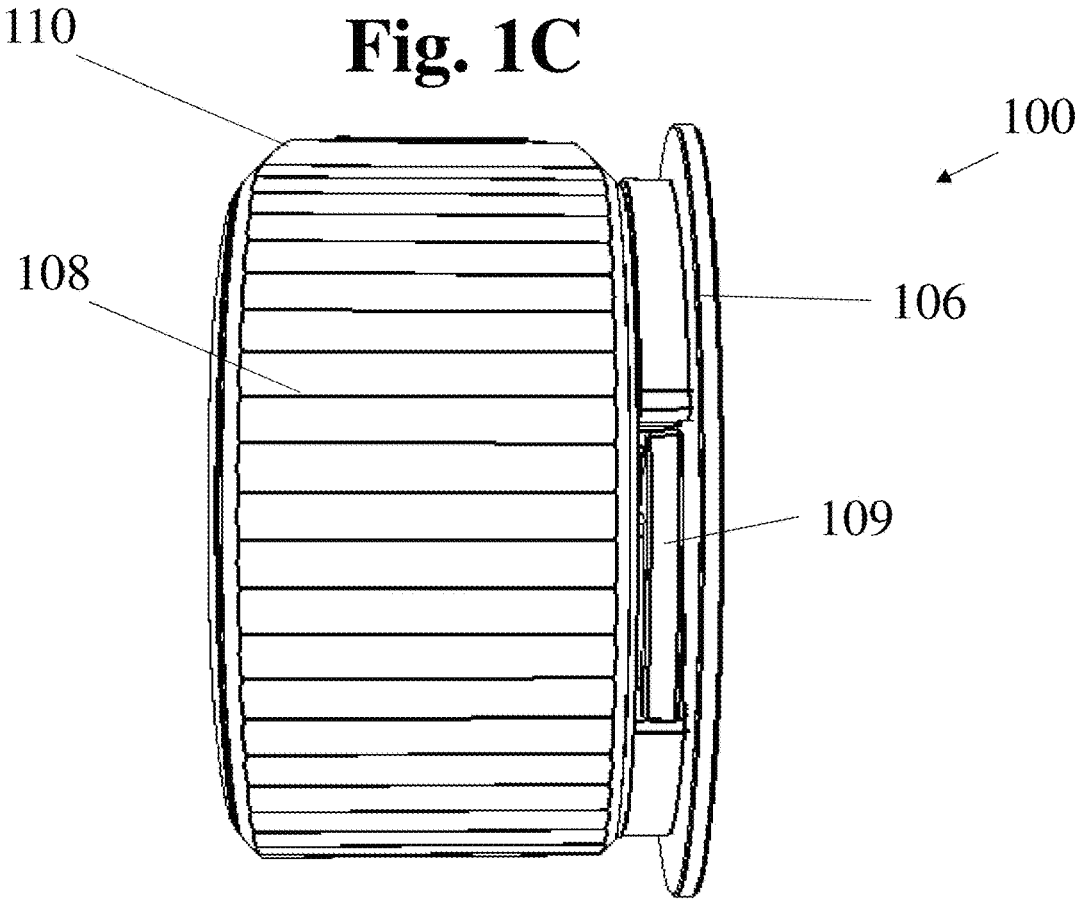
FIG. 1D is a right side view of the rotary knob of FIG. 1A.

As seen in FIG. 1C, the mounting plate 106 includes a rear aperture 112 that allows an existing cam shaft of a deadbolt to extend into the chassis to functionally engage with the drive mechanisms of the rotary knob as will be described below. Screw mounts 114 may accommodate screws, bolts, or other fasteners to be used for securing the knob to the surface of a door. As should be understood, the rear aperture 112 may be of any shape, and there may be more or fewer screw mounts than depicted.

As depicted, the outer surface 108 of the outer wall is patterned with a plurality of ridges running along the circumference of the wall. It is contemplated that such ridges may facilitate a user's grip of the outer wall. It should be understood that the outer wall of other embodiments may include a higher or lower density of ridges, may only be partially covered in friction features, may have different features such as studs, or other protrusions, or may lack grippable features entirely.

Figure 2:
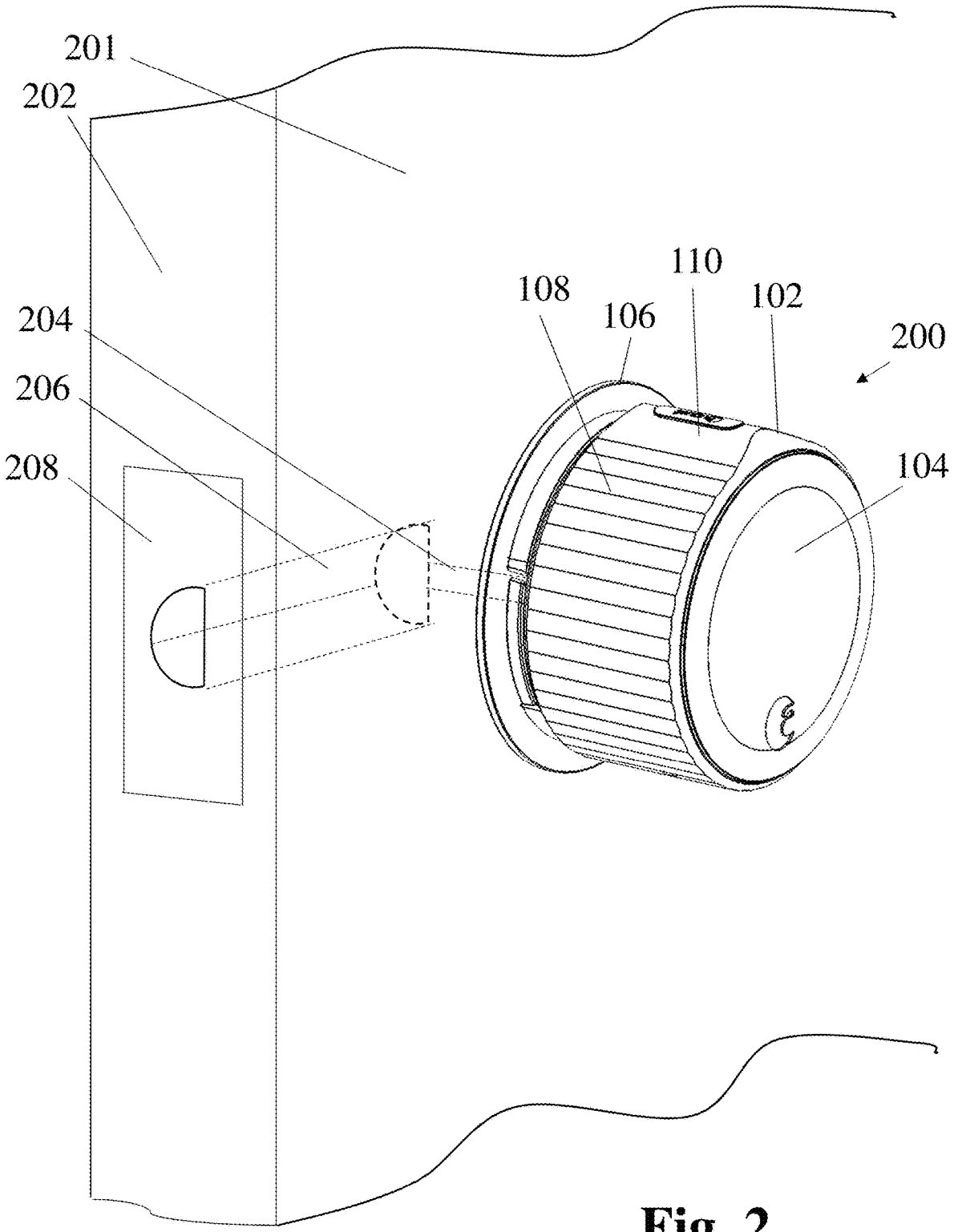
FIG. 2 is a front, left, perspective view of the rotary knob according to one embodiment, mounted to a representative door including a deadbolt.

FIG. 2 shows the rotary knob 200 according to one embodiment attached to an inside surface of a representative door 201. Door 201 may be equipped with a deadbolt lockset, with bolt 206 shown retracted within the door. Cam shaft 204 may operatively connect to the bolt 206 such that rotation of the cam shaft 204 about its longitudinal axis causes the bolt 206 to shift linearly inward (retracted) and outward (extended) relative to the strike 208 on the side 202 of the door. In this respect, the chassis 102 of the knob may be grasped and rotated by a user to rotate cam shaft 204 and drive bolt 206. In this embodiment of the rotary knob, rotation of the knob directly drives the bolt, meaning that there is a one-to-one correspondence of rotation distance to linear movement. However, other embodiments are contemplated where rotation of the knob may rotate the cam shaft via a gear train that reduces the drive ratio.

While the rotary knob is primarily described and depicted as being used to operate bolts for doors, it should be understood that the applications are not limited to traditional entrance and exit doors. For example, the rotary knob may operate a bolt for a safe or a closet. The rotary knob may also operate bolts for objects that are not swung open for access, for example, drawers that can be key locked. Other applications are also contemplated.

Figure 3:
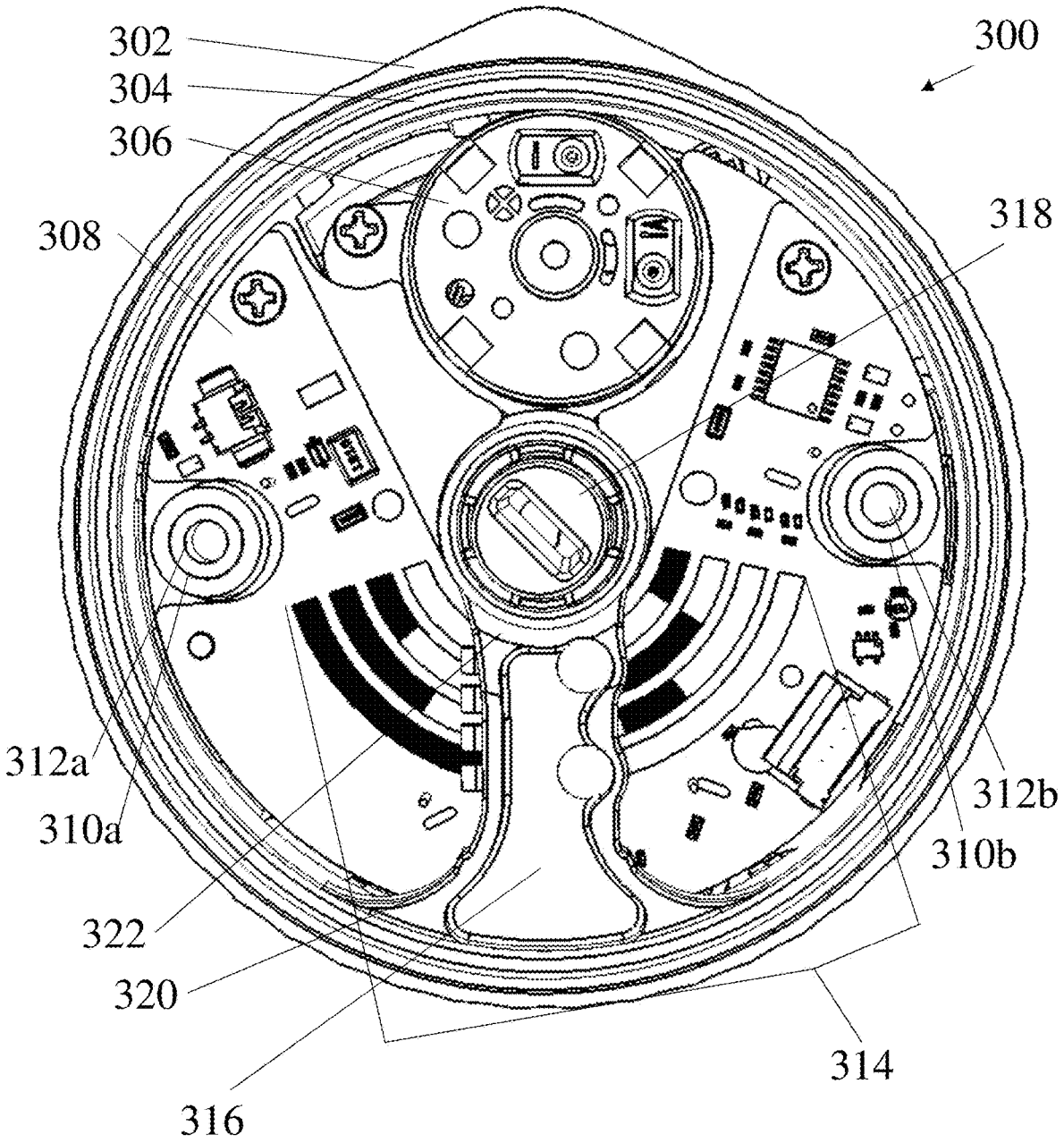
FIG. 3 is a rear view of the rotary knob according to one embodiment with a rear plate removed.
Figure 4:
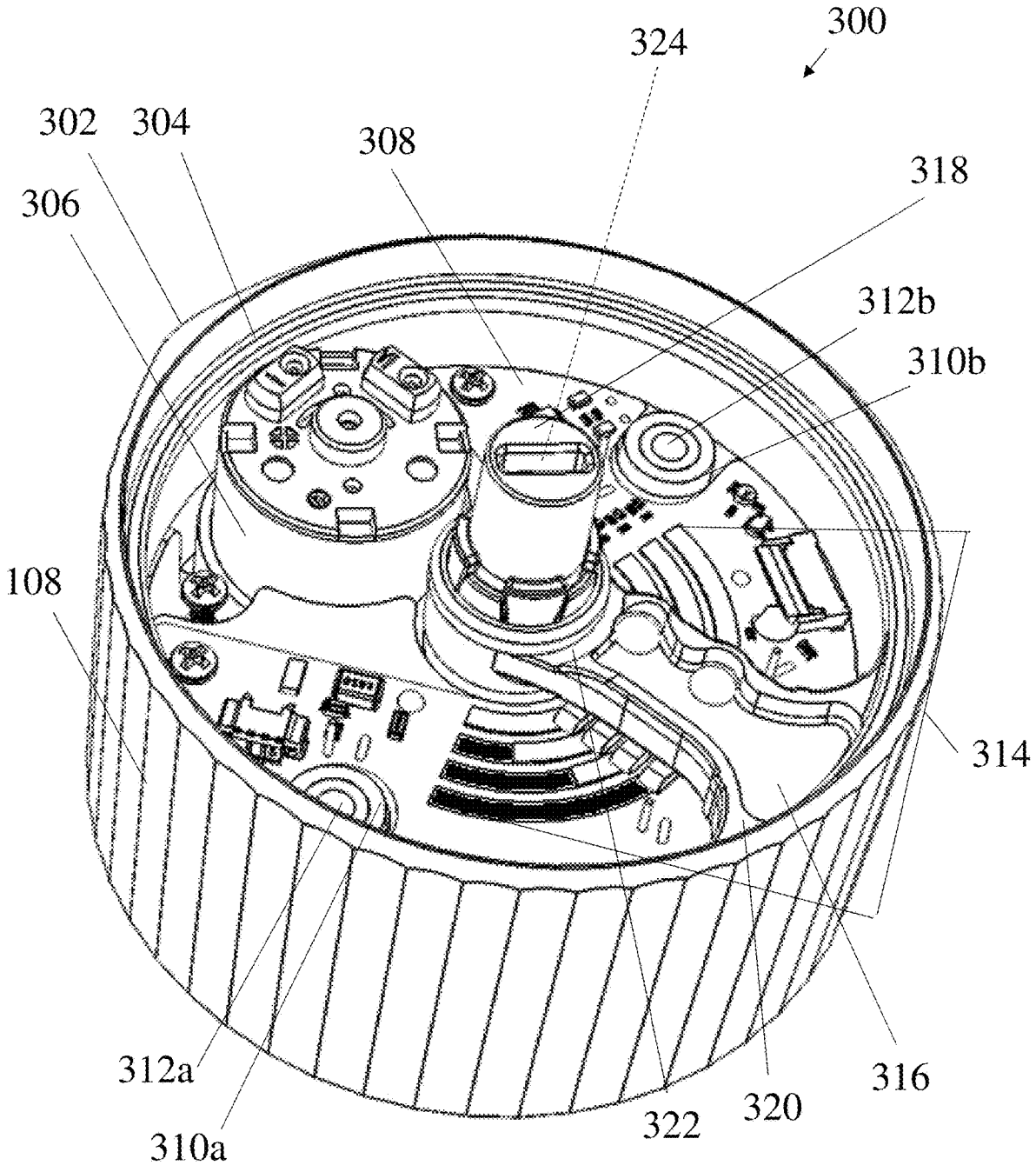
FIG. 4 is a rear, left perspective view of the rotary knob of FIG. 3.

FIGS. 3 and 4 show the rotary knob 300 according to one embodiment with some components removed for clarity to provide a view into the chassis. Outer wall 302 marks the boundary of the chassis, with the inner surface 304 of the outer wall facing inwards. It should be understood that the chassis may be rotatable relative to other components of the rotary knob, including some components that are covered by the chassis.

The chassis of the rotary knob 300 contains at least the motor 306, the circuit board 308 including signal traces 314, the adaptor 318, and first and second stoppers 310*a* and 310*b*. As will be described below, motor 306 may also drive rotation of the cam shaft to actuate the bolt, adaptor 318 allows the knob 300 to connect to the cam shaft, and the first and second stoppers 310*a* and 310*b* limit rotation of the chassis.

Figure 5A:
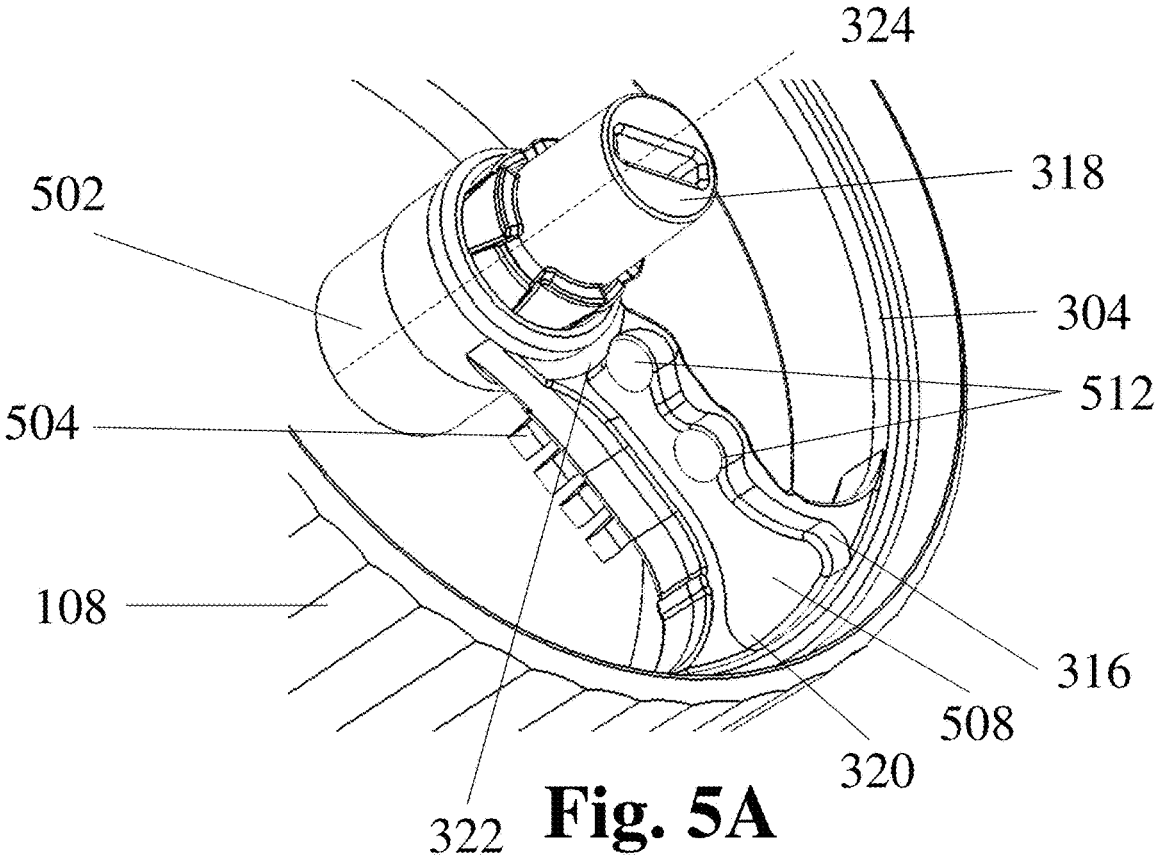
FIG. 5A is a rear, bottom, left, perspective view of a portion of the rotary knob showing cantilevered beam and adaptor according to one embodiment.
Figure 5B:
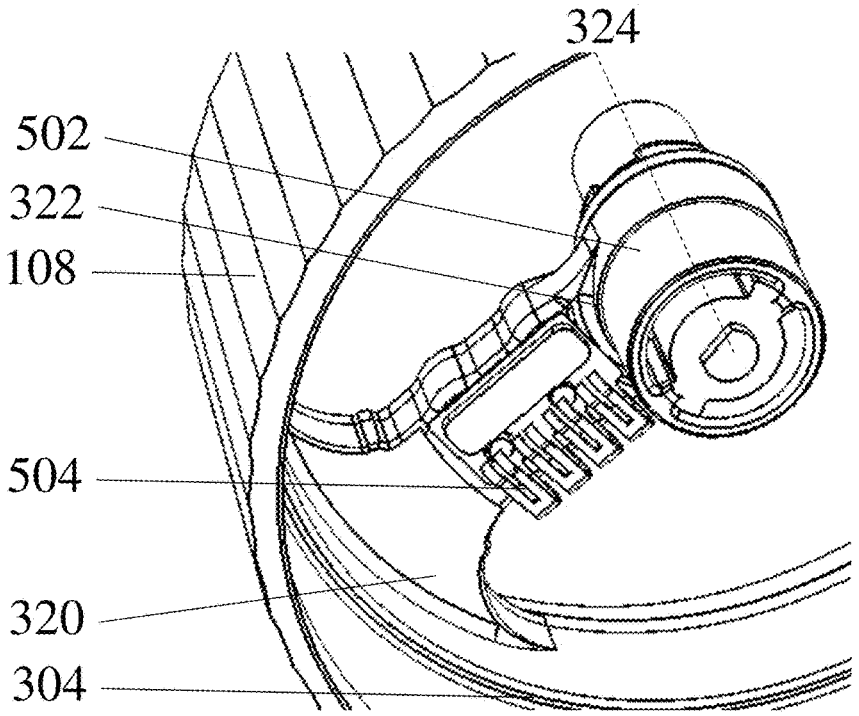
FIG. 5B is a front, bottom, left perspective view of a portion of the rotary knob showing the cantilevered beam and adaptor according to one embodiment.

Cantilevered beam 316 is fixed at a fixed end 320 to the inner surface 304 of the outer wall 302. The beam 316 may extend towards the central axis of the knob 324, terminating in free end 322. As seen in FIGS. 5A and 5B, free end 322 may connect to a central portion 502 of the chassis, which may be free to rotate about the central axis of the knob 324 along with the cantilevered beam 316 and outer wall 304. The central portion 502 may at least partially retain adaptor 318, causing adaptor 318 to rotate with central portion 502, thereby allowing rotation of the outer wall 304 of the knob to directly cause rotation of the cam shaft via adaptor 318. As the outer wall 304 rotates, the cantilevered beam 316 rotates relative to circuit board 308.

In some embodiments, cantilevered beam 316 may include a depressed portion 508. In these embodiments, the cantilevered beam 316 may have a transverse cross-sectional profile similar to an I-beam. Without wishing to be bound by theory, shaping the cantilevered beam in this manner may result in a suitable strength due to material volume benefits associated with an I-beam shape. Other embodiments of the cantilevered beam may also include depressed portions 508 of varying depths, no depressed portion to produce a standard rectangular cross-section, or multiple depressed portions and even protruding portions to produce a variety of cross-sectional shapes. The cross-sectional shape of the cantilevered beam of the current application is not limited to any one shape.

The cantilevered beam may be formed of the same material as the outer wall, or may be formed of a different material that provides suitable rigidity to maintain structural integrity of the beam. The beam may be formed integral with, or otherwise attached to, the inner surface of the outer wall and central portion.

As best seen in FIG. 5B, which is an underside view of the cantilevered beam, electrical contact 504 may extend from the cantilevered beam 316 in a direction towards the circuit board 308 (not shown in FIG. 5B). As the cantilevered beam 316 rotates across circuit board 308, electrical contact 504 contacts the signal traces on the circuit board 308 at various rotational positions, as will be described further below. Electrical contact 504 may be attached to the cantilevered beam 316 at least partially with heat stake pins 512, which may serve to both maintain the attachment between the electrical contact 504 and the cantilevered beam 316.

Figure 6:
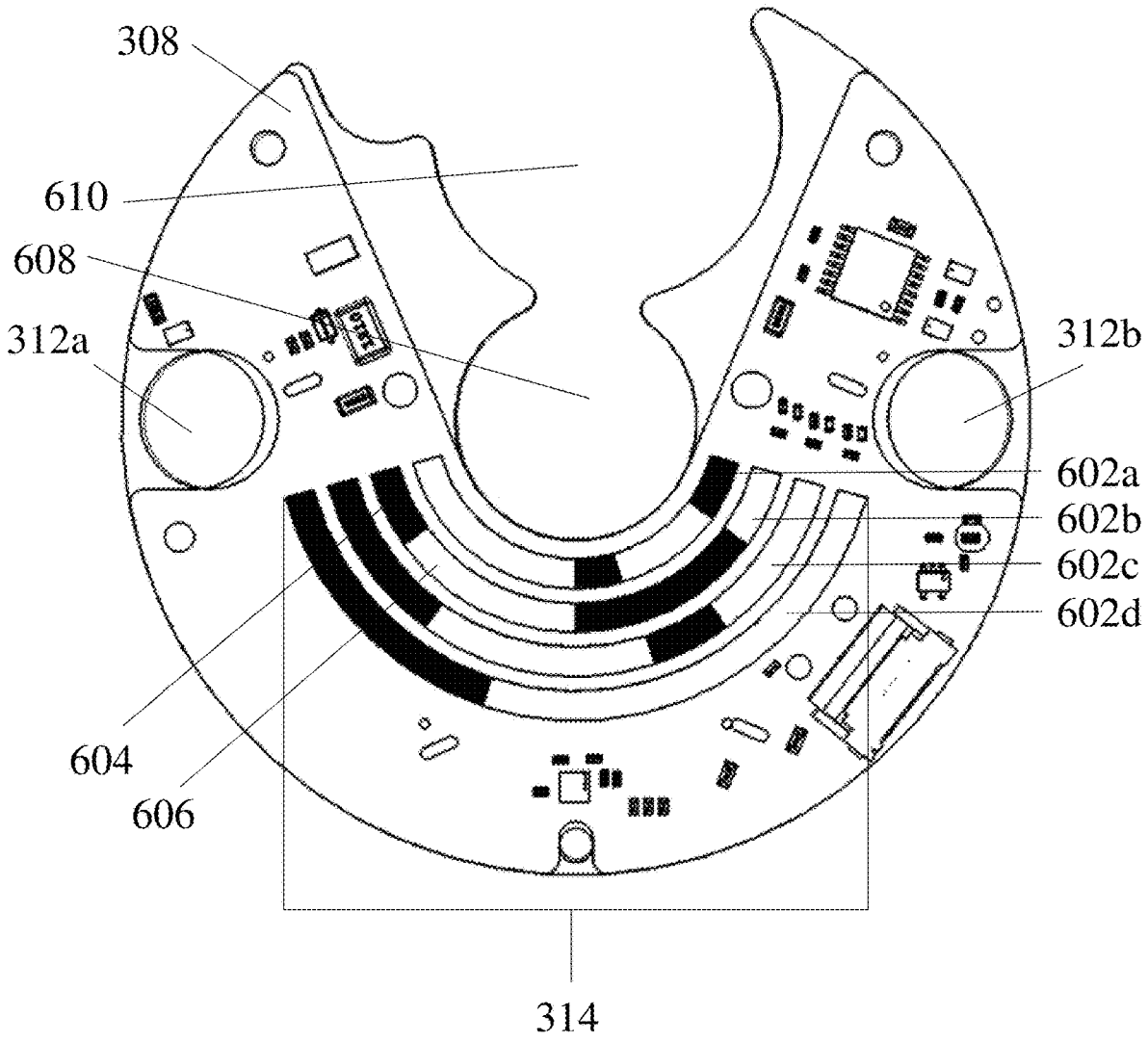
FIG. 6 is a rear view of a circuit board and associated electrical components of the rotary knob according to one embodiment.

FIG. 6 shows the circuit board 308 of the rotary knob according to one embodiment. The circuit board 308 of the depicted embodiment may be shaped and sized to fit within the chassis such that the rotatable components of the knob may rotate relative to the circuit board. Circuit board 308 includes central aperture 608, which acts as a through-hole to accommodate central portion 502. Circuit board 308 may further include cutout 610, which may accommodate motor 610. Screw holes 312*a* and 312*b* may accommodate fasteners that may contribute to the attachment of the circuit board to the rest of the knob. It should be understood that the number of cutouts, apertures, holes, etc. in the circuit board may vary based on design needs of the rotary knob. Similarly, the components depicted on the circuit board are merely representative and may vary from embodiment to embodiment.

Located on the surface of the circuit board 308 is the plurality of signal traces 314. In some embodiments, signal traces 602*a-d* may be arranged in concentric arcs centered at the central axis of the knob. Non-conductive portions 604 of the arc and conductive portions 606 of the arc are arranged to create continuous arcs that are discontinuously conductive along their lengths. In some embodiments, a plurality of signal traces may be positioned along each arc, with areas containing a signal trace corresponding to a conductive portion 606, and areas without a signal trace corresponding to a non-conductive portion 604. In other embodiments, signal traces may span the entire arc, but some portions of the traces may be non-conductive. As depicted, there are four arcs, but it should be understood that any number of arcs may be used.

Figure 7:
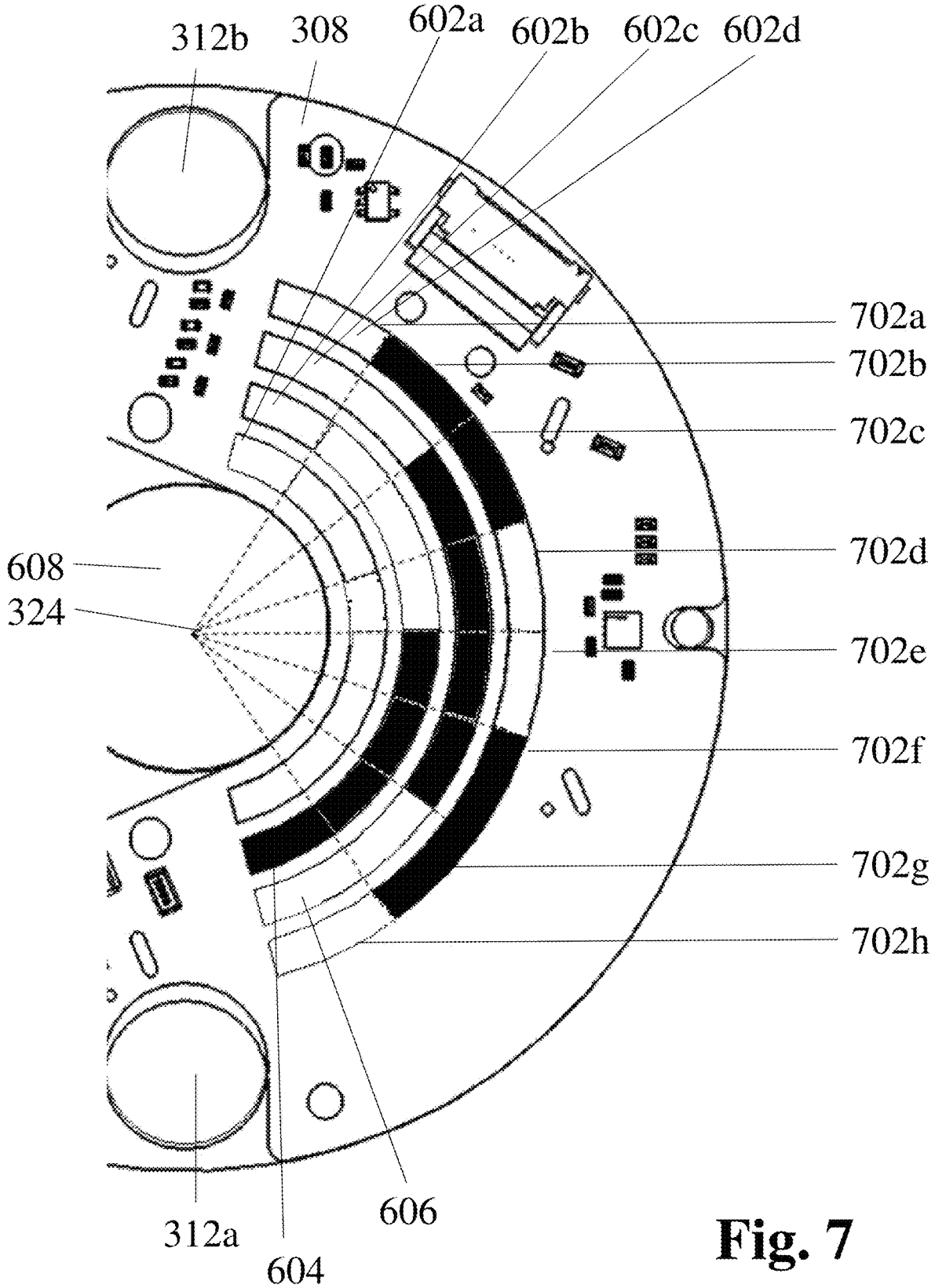
FIG. 7 is a partial rear view of the circuit board of FIG. 6.

FIG. 7 shows a portion of a circuit board according to another embodiment, annotated with dashed lines to graphically show where along the length of the arcs the signal traces may be divided into a plurality of imaginary sectors 702*a*-702*h*. The imaginary sectors may be walled by imaginary radii beginning from the central axis of the knob 324, extending to the arc section formed by the outermost signal trace arc. In the embodiments of FIGS. 6 and 7, each sector may contain a unique combination of conductive portions 606 or non-conductive portions 604 of the signal traces 602*a*-602*d*. As the cantilevered beam 316 sweeps across the circuit board and signal traces, the electrical contact may make an electrical connection with each conductive portion 606 while the cantilevered beam is in the sector containing said conductive portions. Using the combination of conductive and non-conductive portions detected, a controller associated with the rotary knob may determine the rotational position of the cantilevered beam, and accordingly the rotational position of the entire knob. Thus, the arrangement and detection of the signal traces functions as a position encoder.

FIG. 6 shows one embodiment where each sector includes a unique combination that can be hardcoded in the controller to correspond to a rotational position of the knob. FIG. 7 shows another embodiment implementing a binary numeral system similar to Gray Code where non-conductive portions and conductive portions represent either 0 or 1, and each sector is read as a bit pattern. Each sector differs from its adjacent sectors in only one bit. Without wishing to be bound by theory, such an arrangement may facilitate error correction in detection by the controller and facilitate history storing with reduced computational complexity.

As may be appreciated, while the depicted embodiments are divided into 8 sectors, any number of sectors may be utilized. The more sectors the arcs are divided into, the greater the resolution of the position encoding system.

The signal traces in some embodiments may be formed of a conductive solder, copper foil, or foil of another conductive metal, or any other suitable conductive material. The conductive material may be etched, printed, or otherwise precisely positioned on the circuit board. In some embodiments, the signal traces may be regions with high concentrations of conductive particles that may be deposited, sprayed, or otherwise precisely positioned on the circuit board. In still other embodiments, the signal traces may differ in resistivity along the lengths of the signal traces, allowing a controller to additionally determine where along the length of the signal trace the electrical contact is positioned over based on the voltage or current detected by the controller. Other arrangements and materials are contemplated as well.

Figure 8A:
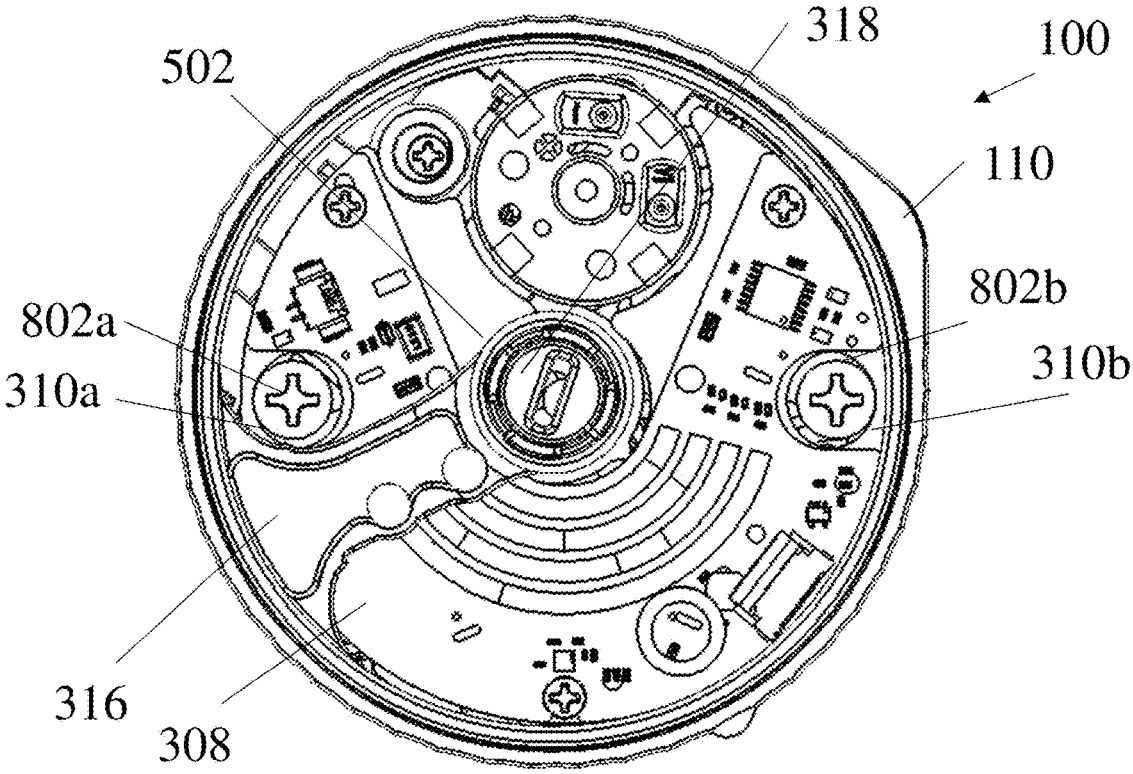
FIG. 8A is a rear view of the rotary knob in one state of rotation.
Figure 8B:
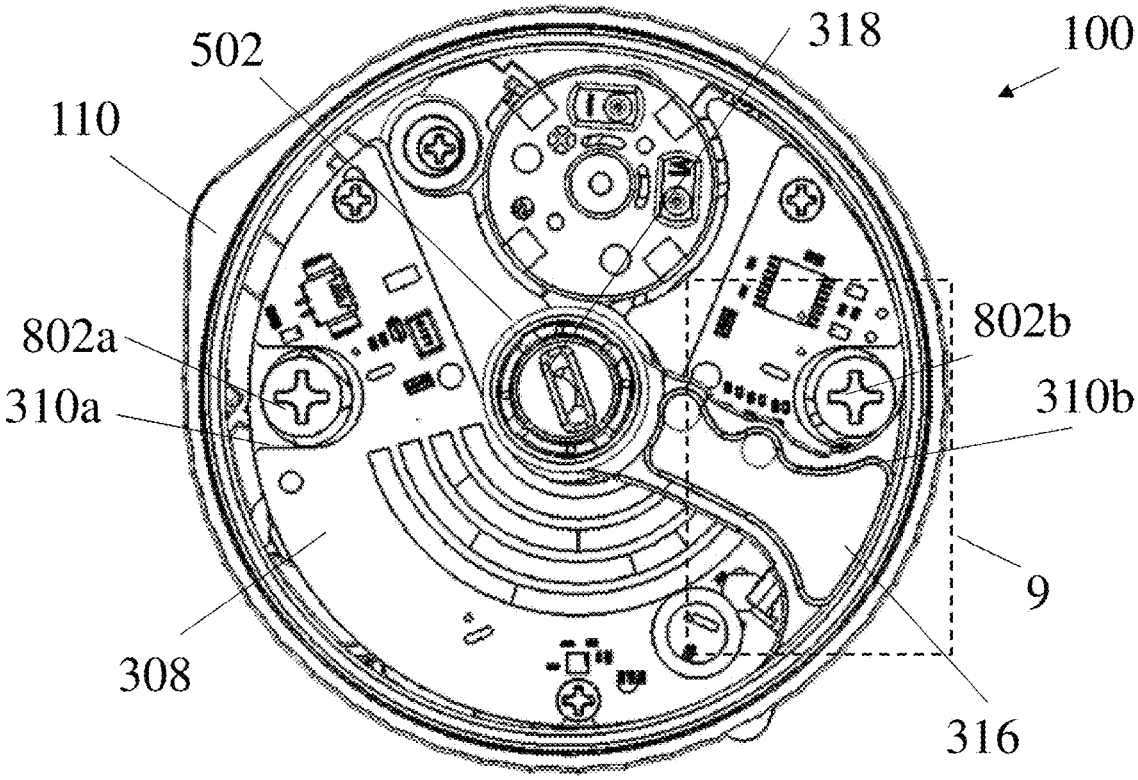
FIG. 8B is a rear view of the rotary knob of FIG. 8A in another state of rotation.

FIGS. 8A and 8B show the rotary knob at the two extremes of its range of rotational positions according to one embodiment. As seen from positions of orientation indicator 110, the chassis of FIG. 8A has been rotated clockwise relative to the underside view, and the chassis of FIG. 8B has been rotated counter-clockwise relative to the underside view. As the outer wall of the rotary knob is gripped at rotated about the central axis of the knob, the cantilevered beam 316, central portion 502, and adaptor 318 rotate with the outer wall. In this embodiment, screws 802*a* and 802*b* may secure the circuit board 308 within the chassis. Stoppers 310*a* and 310*b* surround the screw holes through which screws 802*a* and 802*b* are secured. Continued rotation of the chassis in either the clockwise or counter-clockwise directions may eventually lead to the cantilevered beam 316 physically engaging with one of the stoppers 310*a* or 310*b* depending on the direction of rotation, causing the stoppers to act as hard stops, effectively limiting and defining the possible range of rotational positions of the cantilevered beam and chassis.

Figure 9:
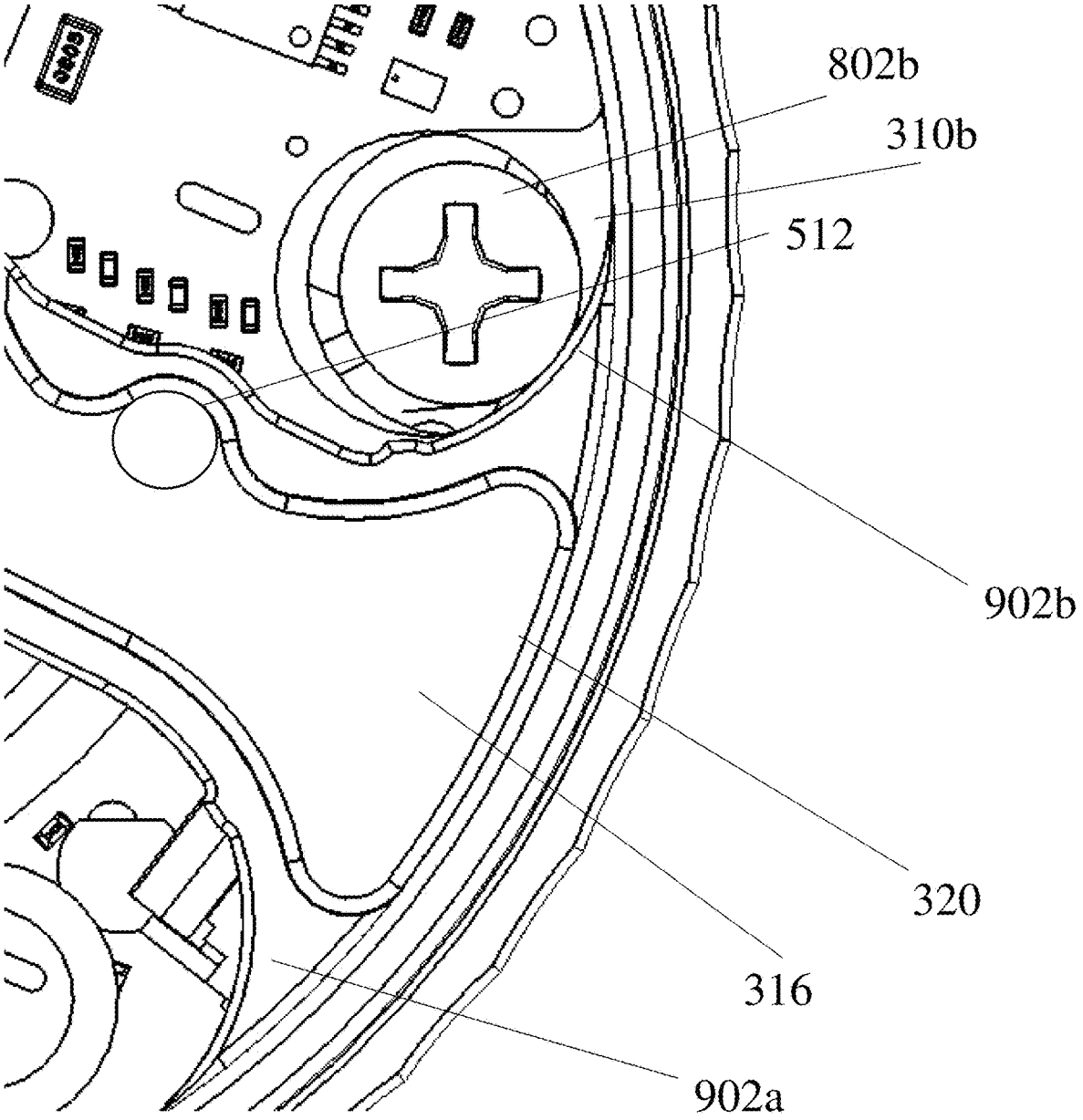
FIG. 9 is a close-up view of a portion of the rotary knob.

FIG. 9 shows a close-up view of the region within box 9 of FIG. 8B. As can be seen in FIG. 9, in some embodiments, the fixed end 320 of cantilevered beam 316 flare laterally, increasing in width towards the outer wall and producing flared ends 902*a* and 902*b*. In these embodiments, the flared ends 902*a* and 902*b* have a curve profile that effectively match the outer profile of the stoppers. In some embodiments, the flared ends 902*a* and 902*b* may be configured to partially wrap around stoppers 310*a* and 310*b* as seen in FIG. 9. It should be understood that other curve profiles for the flared ends may be used in some embodiments. Some embodiments include a cantilever beam that may not flare at all. Otherwise shaped flared ends for the beam are also contemplated. The flared ends may further provide a suitable stress relief at the junction of the end of the cantilevered beam and the outer wall.

The stoppers 310*a* and 310*b* may be comprised of soft polymers, rubber, synthetic rubber, or other elastomers that are soft enough to allow cantilevered beam 316 to bump into the stoppers without damaging the stoppers or the beam. The material of the stoppers may have elasticity to facilitate the dampening of contact between the beam and the stoppers. The stoppers may be of any height and circumference necessary to effectively stop the cantilevered beam from rotating further. It is further contemplated that stoppers may simply be soft or hard walls instead of substantially cylindrical.

In the depicted embodiments, the screws 802*a* and 802*b* and stoppers 310*a* and 310*b* are positioned near diametric ends of the rotary knob. However, it should be understood that the stoppers may be placed anywhere within the rotary knob depending on the desired rotational range for the cantilevered beam. Depending on the linear range of the bolt, the drive ratio for rotation of the chassis to linear movement of the bolt, and other factors may lead one to desire a larger or small rotation range than as depicted. Embodiments are also contemplated with multiple stoppers positioned at each rotational limit to spread out force experienced by the beam and stoppers when rotated to the hard stop provided by the stoppers.

In the depicted embodiment, the chassis of the rotary knob can be rotated over a range of 170 degrees from hard stop to hard stop. However other ranges are also contemplated. For example, the rotational range may be unlimited in embodiments where several full rotations of the chassis are required to bring the bolt between retracted and extended positions. Rotational range may also be greater than 270 degrees, or from 270-260 degrees, or 260-250 degrees, or 250-240 degrees, or 240-230 degrees, or 230-220 degrees, or 220-210 degrees, or 210-200 degrees, or 200-190 degrees, or 190-180 degrees, or 180-170 degrees, or 170-160 degrees, or 160-150 degrees or 150-140 degrees, or 140-130 degrees, or 130-120 degrees, or 120-110 degrees, or 110-100 degrees, or 100-90 degrees, or less than 90 degrees. Other ranges are also contemplated.

Figure 10A:
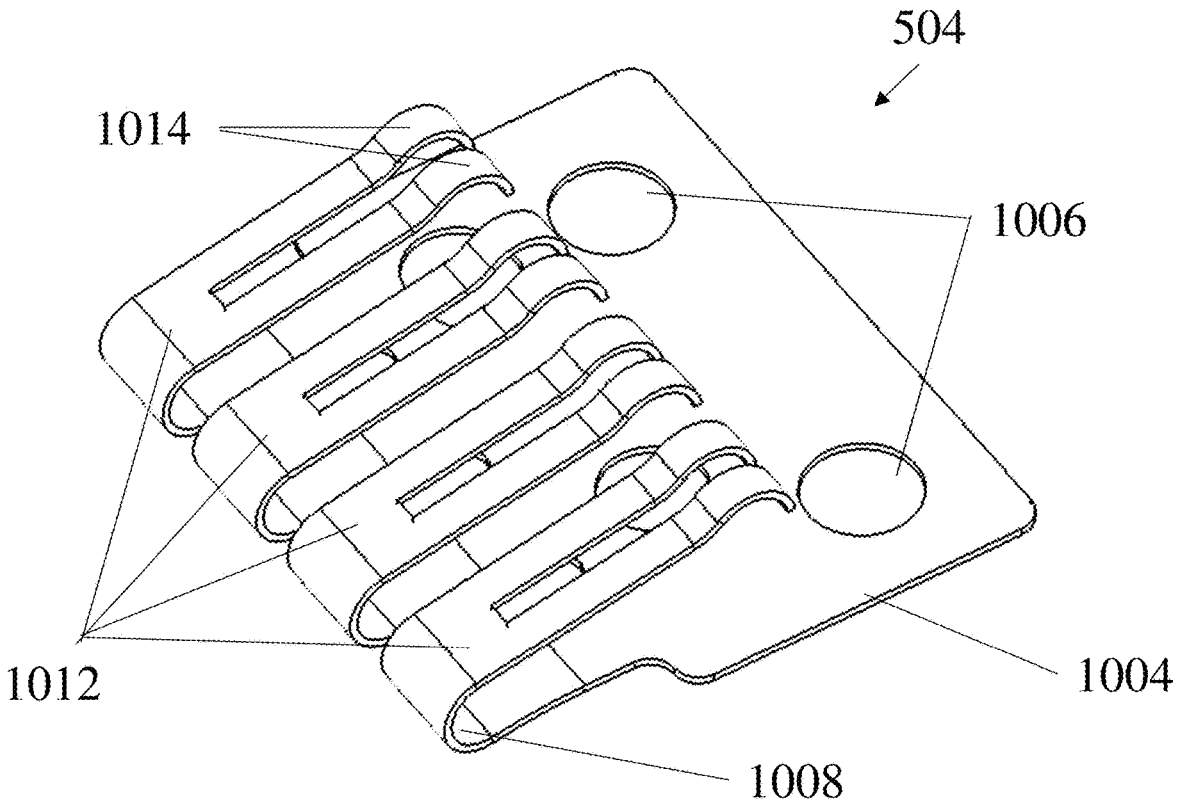
FIG. 10A is a bottom, front, left, perspective view of an electrical contact of the rotary knob according to one embodiment.
Figure 10B:
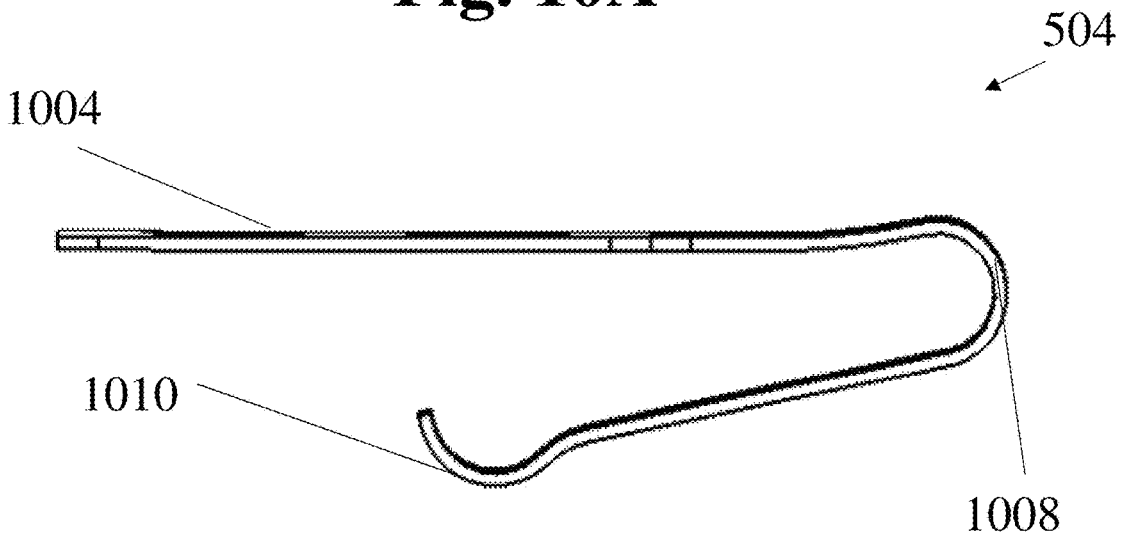
FIG. 10B is a left view of the electrical contact of FIG. 10A.

FIGS. 10A and 10B show the electrical contact 504 according to one embodiment from a perspective view and a side view respectively. Leaf springs 1012 may include a plurality of members extending from one end of the base plate 1004. The members may form a hairpin bend 1008 such that contact regions 1014 of the leaf springs rest in a plane vertically removed from the plane of the base plate 1004. Base plate 1004 may be attached to the cantilevered beam such that the leaf springs 1012 extend towards the circuit board and signal traces. In some embodiments, the leaf springs 1012 may further branch out to form multi-pronged contacts, as depicted in FIG. 10A. Such multi-pronged contacts may provide redundant contact points between a signal trace and a leaf spring, improving reliability of electrical conduction. In some embodiments, the multi-pronged ends may further be hooked, such that the contact regions 1014 on hooked ends 1010 protrude closer to the circuit board and signal traces.

As the cantilevered beam rotates across the signal traces, the leaf springs may make electrical contact with the signal traces. In some embodiments, the leaf springs may deform due to normal force from physical contact with the signal traces, causing the leaf springs 1012 to bend at the hairpin bends 1008 such that the hooked ends 1010 move towards the base plate 1004. This bending causes the hooked ends 1010 to experience an elastic restoring force, pressing contact regions 1014 with additional force into the signal traces, further improving contact and reliability of electrical conduction between the signal traces and electrical contact 504. In some embodiments, the signal traces may protrude from the plane of the circuit board to increase the deformation experienced by the leaf springs upon contact with the signal traces.

It should be understood that the depicted embodiment shows just one possible arrangement of electrical contact 504. For example, the electrical contact may have more or fewer leaf springs depending on the number of electrical contacts to be contacted. Furthermore, while the depicted embodiment includes one leaf spring per arc of signal traces, embodiments with multiple leaf springs corresponding to a single arc, or single leaf springs being large enough to contact multiple signal trace arcs are also contemplated. Additionally, embodiments are contemplated without multi-pronged ends, or with more prongs than the two prongs in the depicted embodiment. The leaf springs may also extend further or not as far from the base plate, in each of the possible dimensions. The ends of the leaf springs may also include larger or smaller curved ends, or may include additional curved portions or other shape variations. In some embodiments, the contact regions may include other topographical features such as studs or ridges. It should be understood that the leaf springs and the electrical contact may be of any shape that would be capable of making electrical connection with the signal traces as the cantilevered beam rotates across the signal traces.

It is contemplated that the electrical contact may be formed of any combination of conductive materials, or non-conductive materials coated in a conductive material.

The electrical contact may be attached to the cantilevered beam in some embodiments using adhesives, or in other embodiments using mechanical fasteners that may extend through pin holes 1006. Welding or integral formation with the rest of the cantilevered beam is also contemplated. Some embodiments may use multiple mechanisms of attachment, as a non-limiting example, some embodiments rely on a combination of adhesive and heat stake pins 512 to attach the electrical contact to the cantilevered beam.

Figure 11A:
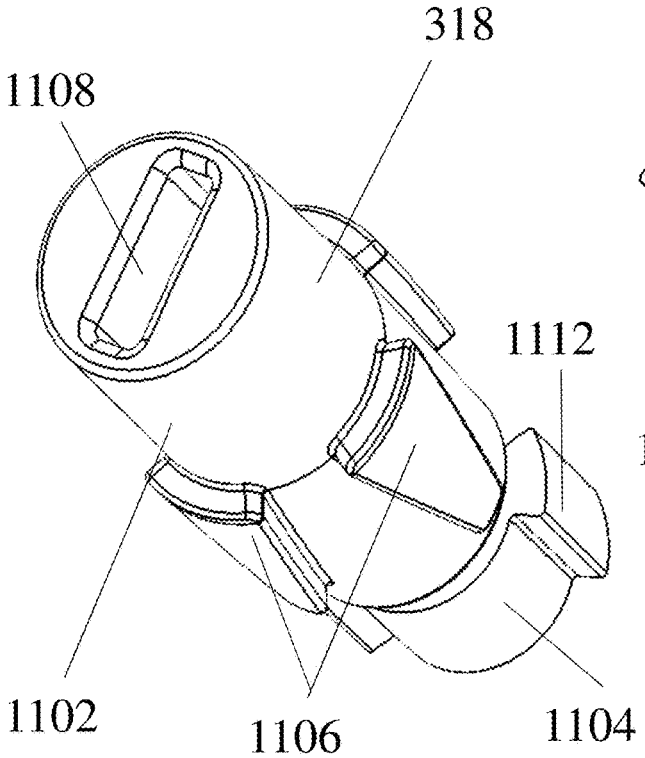
FIG. 11A is a rear, bottom, right perspective view of an adaptor and drive cam of the rotary knob according to one embodiment.
Figure 11B:
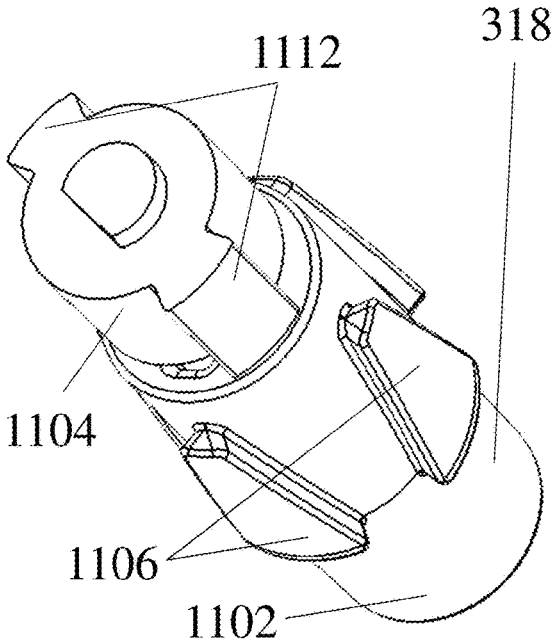
FIG. 11B is a front, bottom, right perspective view of the adaptor and drive cam of FIG. 11A.
Figure 11C:
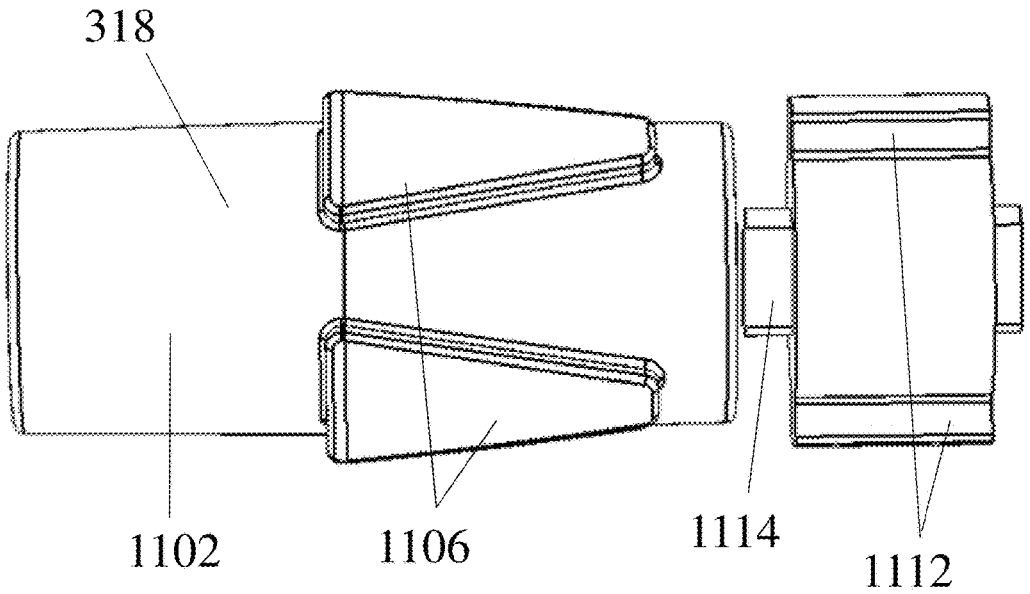
FIG. 11C is a side view of the adaptor and drive cam of FIG. 11A.
Figure 12A:
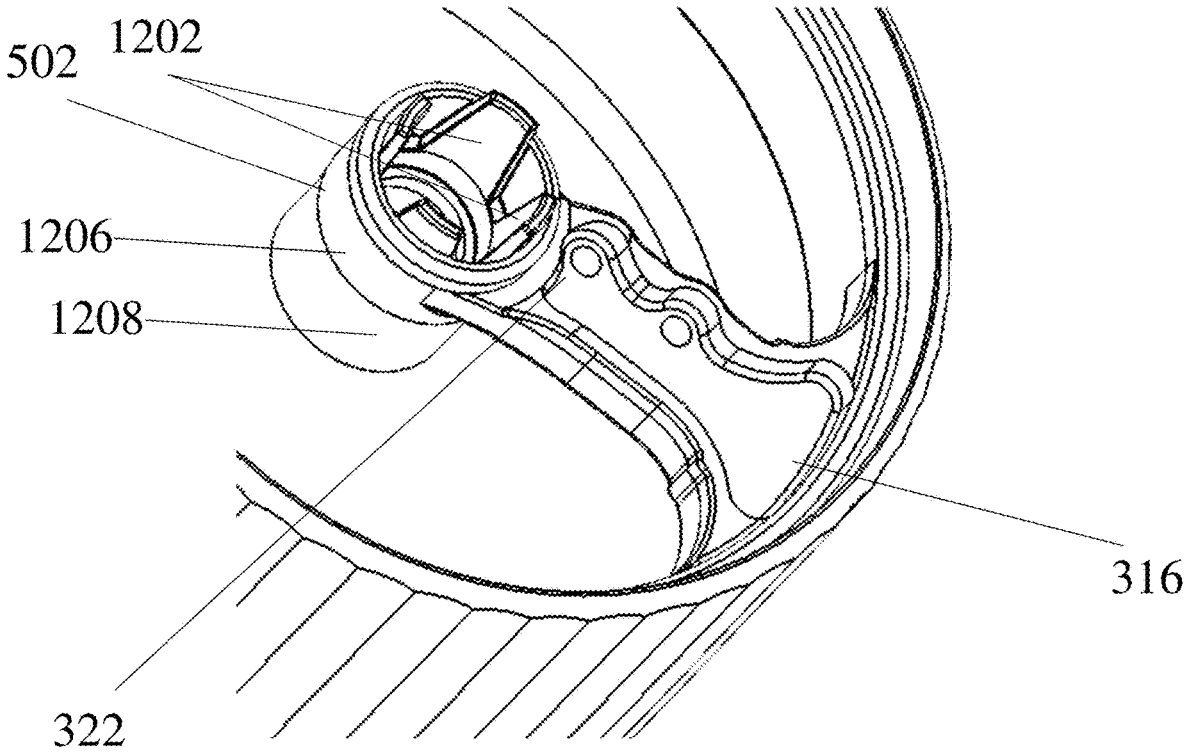
FIG. 12A is a portion of a rear, bottom, left perspective view of the cantilevered beam of the rotary knob.
Figure 12B:
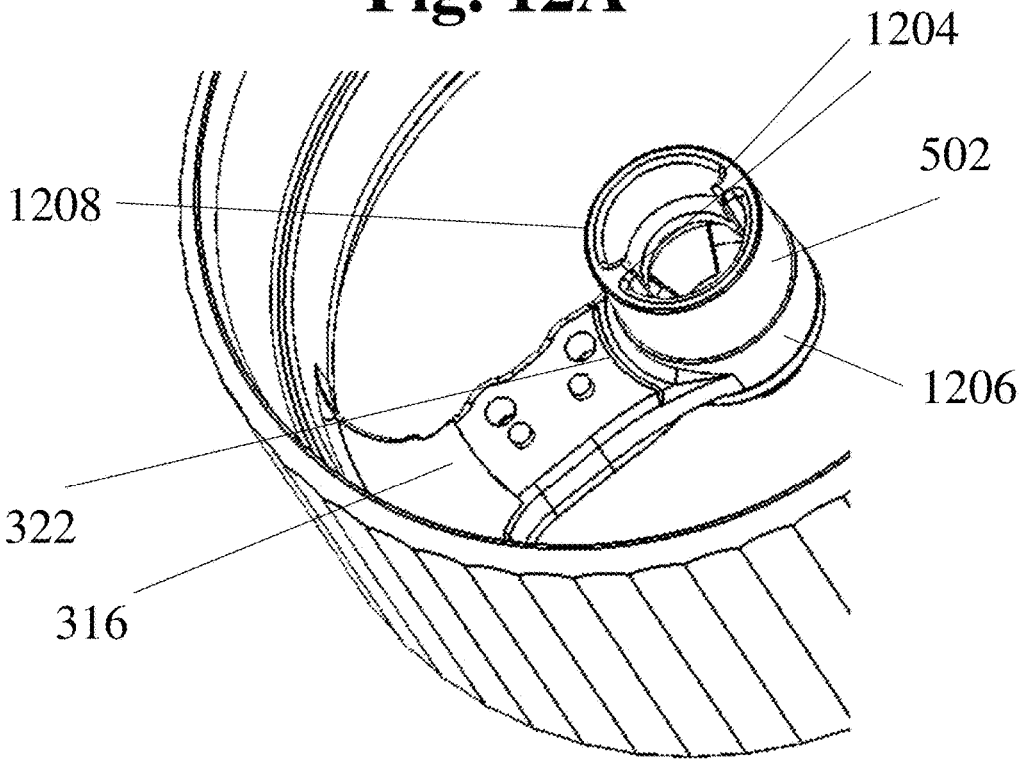
FIG. 12B is a front, bottom, right perspective view of the cantilevered beam of FIG. 12A.

FIGS. 11A-11C show different views of the components that fit within the central portion 502. FIGS. 12A and 12B show the central portion with the components of FIGS. 11A-11C hidden. Central portion 502 may be divided into adaptor end 1206 and drive end 1208. Adaptor end 1206 may act as a receptacle for the removable adaptor 318, while drive end 1208 may contain drive cam 1104. Adaptor end 1206 may be attached or integral with free-end 322 of the cantilevered beam 316 such that the central portion 502, and the adaptor 318 when contained at least partially within the central portion, rotates about the central axis of the knob with the cantilevered beam.

As best seen in FIG. 11A, adaptor 318 includes a slot 1108 to receive a cam shaft of the lock set such that rotation of the chassis is transmitted to the cam shaft. The adaptor may further include attachment features 1106 that may interact with receiving features 1202 on the inner surface of the adaptor end 1206 of central portion 502 to retain the adaptor 318. To accommodate a variety of possible existing cam shaft shapes, adaptor 318 may be removed from the central portion and replaced with another adaptor with a differently shaped slot 1108 which may accommodate other cam shaft shapes.

Figure 13:
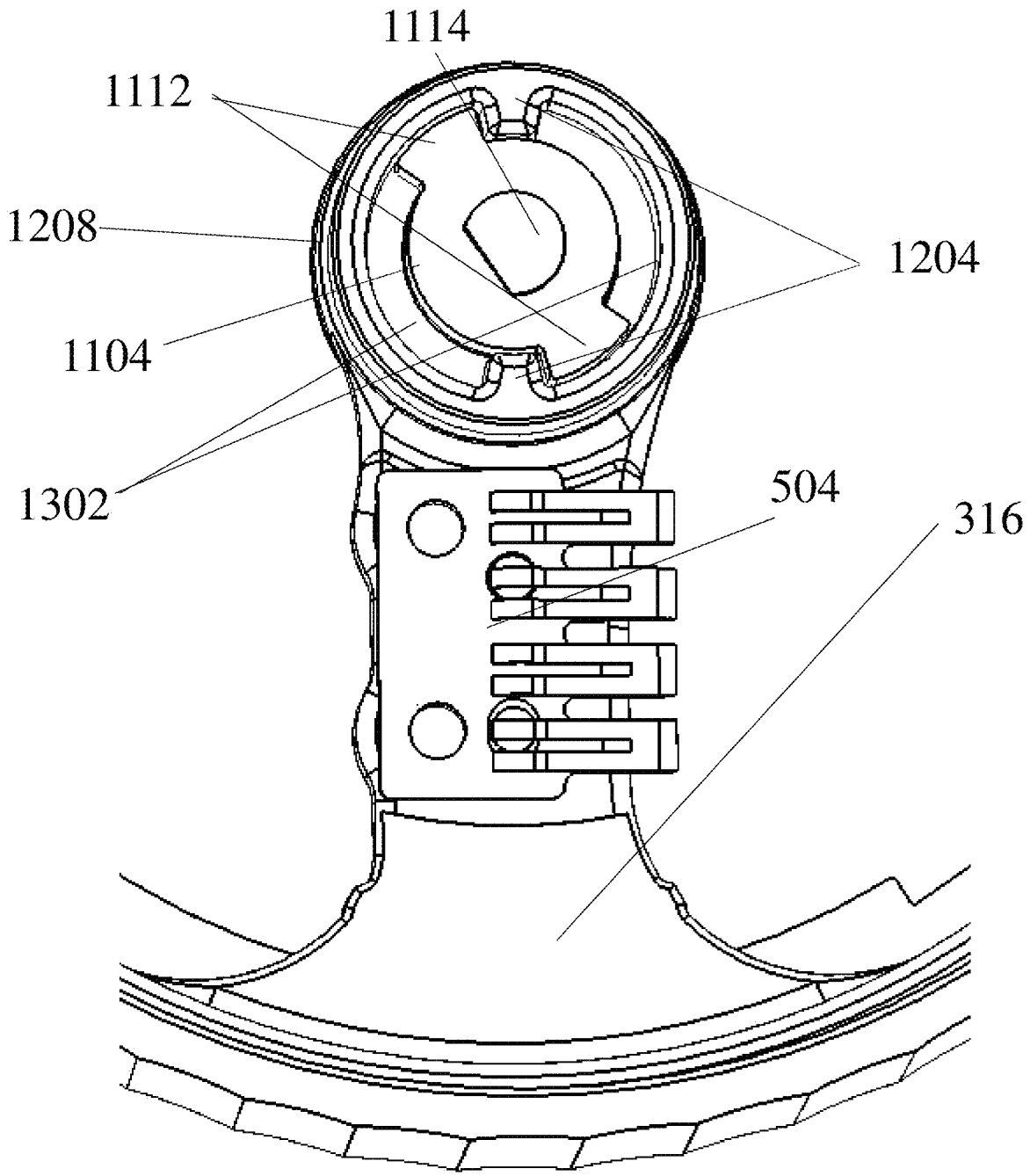
FIG. 13 is a close-up view of a portion of the rear end of the cantilevered beam, central portion, and drive cam of the rotary knob according to one embodiment.

Drive cam 1104 may be disposed on drive shaft 1114 such that the drive cam rotates with drive shaft 1114 about the longitudinal axis of drive shaft 1114. Drive cam 1104 includes outwardly extending wings 1112 such that the wings may physically interact with protrusions 1204, extending from the inner surface of drive end 1208 (see FIG. 12B). Turning to FIG. 13, the protrusions 1204 are spaced about the inner surface of drive end 1208 to create rotation channels 1302. The spacing of the protrusions 1204 means that drive cam 1104 may rotate with the drive shaft 1114 for a short period through channels 1302 prior to contacting the protrusions 1204. When the motor is triggered to drive the bolt, the motor may rotate the drive shaft 1114, also rotating drive cam 1104. Drive cam 1104 rotates unobstructed until the wings 1112 encounter drive shaft 1114. Continued driving from the motor causes the drive cam 1104 to continue rotating, causing the wings 1112 to push protrusions 1114, rotating the central portion 502. Due to central portion 502 being fixed to the cantilevered beam, rotation of central portion 502 causes the entire chassis to rotate. Similarly, due to adaptor 318 being at least partially within central portion 502, rotation of central portion 502 causes the adaptor and thereby the cam shaft of the lock set to rotate, actuating the bolt.

In some embodiments, the drive end 1208 may be configured such that the protrusions 1114 are positioned such that manual rotation of the knob from one extreme of its rotation range to the other extreme rotates the central portion the full distance between the wings within channel 1302 without actually rotating the drive cam 1104. As such, manual rotation of the knob may rotate the adaptor and cam shaft without applying a rotation force to the drive shaft. This may allow the rotary knob to be manually operable without back-driving and damaging the motor.

In the depicted embodiment, the attachment features 1106 and receiving features 1202 are interlocking teeth that extend from their respective surfaces. The attachment features and receiving features may interlock to engage the adaptor and central portion. However, it should be understood that other features may be contemplated to ensure retention of the adaptor within the central portion 502 and the current disclosure is not limited to the depicted embodiment. As a non-limiting example, the adaptor and central portion may include snap features that allow the adaptor to snap into place.

While the embodiment of the knob shown is depicted as a cylinder that may be shorter than its diameter, it should be understood that the knob may be shaped in any suitable manner. The cylinder or other shape may have any radius or height as long as the knob is suitably sized to house the various components described herein, yet remain ergonomically useable.

In some embodiments of the rotary knob, the various components of the chassis and mounting plate may be made of plastic, metal, or other rigid materials capable of withstanding gripping forces and pulling forces applied by a user. The front cover may be integrally molded or otherwise formed with the outer wall, or may be welded to the outer wall, or may snap into place at the edge of the outer wall, or may use any other form of attachment including, but not limited to, adhesives, relying on fastening structures such as bolts and screws, or any other form of attachment that would not compromise functionality of the knob. In the depicted embodiment, the chassis is latched onto the mounting plate, and may be released by depressing latch 109. However, it should be understood that any method of removably attaching the chassis to the mounting plate is also contemplated as long as the chassis is capable of rotating relative to the mounting plate.

The above-described embodiments of the technology described herein can be implemented in any of numerous ways. For example, the controller of various embodiments described above may be implemented using hardware, software or a combination thereof. When implemented in software, the software code can be executed on any suitable processor or collection of processors, whether provided in a single computer or distributed among multiple computers. Such processors may be implemented as integrated circuits, with one or more processors in an integrated circuit component, including commercially available integrated circuit components known in the art by names such as CPU chips, GPU chips, microprocessor, microcontroller, or co-processor. Alternatively, a processor may be implemented in custom circuitry, such as an ASIC, or semicustom circuitry resulting from configuring a programmable logic device. As yet a further alternative, a processor may be a portion of a larger circuit or semiconductor device, whether commercially available, semi-custom or custom. As a specific example, some commercially available microprocessors have multiple cores such that one or a subset of those cores may constitute a processor. Though, a processor may be implemented using circuitry in any suitable format.

Also, the various methods or processes executed by the controller as described above may be coded as software that is executable on one or more processors that employ any one of a variety of operating systems or platforms. Additionally, such software may be written using any of a number of suitable programming languages and/or programming or scripting tools, and also may be compiled as executable machine language code or intermediate code that is executed on a framework or virtual machine.

The terms "program" or "software" are used herein in a generic sense to refer to any type of computer code or set of computer-executable instructions that can be employed to program a computer or other processor to implement various aspects of the present disclosure as discussed above. Additionally, it should be appreciated that according to one aspect of this embodiment, software when executed to perform methods of the present disclosure need not reside on a single controller or processor, but may be distributed in a modular fashion amongst a number of different controllers or processors to implement various aspects of the present disclosure.

Computer-executable instructions may be in many forms, such as program modules, executed by one or more computers or other devices. Generally, program modules include routines, programs, objects, components, data structures, etc. that perform particular tasks or implement particular abstract data types. Typically the functionality of the program modules may be combined or distributed as desired in various embodiments.

Various aspects of the present disclosure may be used alone, in combination, or in a variety of arrangements not specifically discussed in the embodiments described in the foregoing and is therefore not limited in its application to the details and arrangement of components set forth in the foregoing description or illustrated in the drawings. For example, aspects described in one embodiment may be combined in any manner with aspects described in other embodiments.

Also, the embodiments described herein may be embodied as a method, of which an example has been provided. The acts performed as part of the method may be ordered in any suitable way. Accordingly, embodiments may be constructed in which acts are performed in an order different than illustrated, which may include performing some acts simultaneously, even though shown as sequential acts in illustrative embodiments.

Further, some actions are described as taken by a "user." It should be appreciated that a "user" need not be a single individual, and that in some embodiments, actions attributable to a "user" may be performed by a team of individuals and/or an individual in combination with computer-assisted tools or other mechanisms.

While the present teachings have been described in conjunction with various embodiments and examples, it is not intended that the present teachings be limited to such embodiments or examples. On the contrary, the present teachings encompass various alternatives, modifications, and equivalents, as will be appreciated by those of skill in the art. Accordingly, the foregoing description and drawings are by way of example only.

What is claimed is:

1. A rotary knob for operating an electronically actuatable deadbolt, the rotary knob comprising:

a chassis;

an outer wall rotatably coupled to the chassis about a central axis of the rotary knob;

a cantilevered beam attached to an inner surface of the outer wall and extending towards the central axis of the rotary knob such that the cantilevered beam is configured to rotate with the outer wall about the central axis;

a circuit board coupled to the chassis, the circuit board including a first signal trace, and an electrical contact extending from the cantilevered beam in a direction toward the first signal trace and electrically connectable with the first signal trace.

2. The rotary knob of claim 1, further comprising a controller configured to determine a position of the deadbolt based on at least a state of electrical connection between the electrical contact and at least the first signal trace.

3. The rotary knob of claim 1, wherein the cantilevered beam includes a free-end adjacent the central axis, the free-end of the cantilevered beam being operatively coupled to a removable adaptor configured to receive a cam shaft that actuates the deadbolt, and wherein rotation of the outer wall and the cantilevered beam rotates the adaptor about the central axis which rotates the cam shaft and actuates the deadbolt.

4. The rotary knob of claim 1, wherein the cantilevered beam includes a fixed end coupled to the inner surface of the outer wall, and wherein the fixed end of the cantilevered beam flares laterally.

5. The rotary knob of claim 4, further comprising a first stopper, wherein the fixed end of the cantilevered beam is configured to engage the first stopper to limit rotation of the outer wall.

6. The rotary knob of claim 5, further comprising a second stopper, wherein the fixed end of the cantilevered beam is configured to engage the second stopper to limit rotation of the outer wall.

7. The rotary knob of claim 6, wherein the first and second stoppers limit rotation of the outer wall such that the electrical contact is always in contact with at least one of the plurality of signal traces.

8. The rotary knob of claim 7, wherein the first and second stoppers are positioned at opposing diametric ends of the chassis.

9. The rotary knob of claim 7, wherein the first and second stoppers limit rotation of the outer wall over a rotation range of 170 degrees.

10. The rotary knob of claim 5, wherein the fixed end of the cantilevered beam at least partially wraps around the first stopper when engaging the first stopper.

11. The rotary knob of claim 4, wherein the first signal trace is one of a plurality of signal traces.

12. The rotary knob of claim 11, wherein the electrical contact comprises one or more leaf springs each configured to elastically deform when in contact with a respective one of the plurality of signal traces.

13. The rotary knob of claim 12, wherein at least one of the one or more leaf springs comprises a multi-pronged contact end.

14. The rotary knob of claim 11, wherein the plurality of signal traces are arranged along a plurality of continuous arcs on the circuit board.

15. The rotary knob of claim 14, wherein the signal traces are arranged along a plurality of arcs, wherein the arcs are concentric about the central axis.

16. The rotary knob of claim 15, wherein the circuit board is divided into a plurality of sectors, the signal traces are arranged such that the electrical contact is electrically connected with a unique combination of the plurality of signal traces while in each of the plurality of sectors, and a controller is configured to determine a position of the deadbolt based on at least the combination of the plurality of signal traces electrically connected to the electrical contact.

17. The rotary knob of claim 16, wherein the combination of the plurality of signal traces electrically connected to the electrical contact differs by one signal trace between adjacent sectors of the plurality of sectors.

18. The rotary knob of claim 16, wherein the electrical contact comprises one or more leaf springs configured to elastically deform when in contact with one or more of the plurality of signal traces.

19. The rotary knob of claim 11, wherein the plurality of signal traces is arranged along a plurality of discontinuous arcs on the circuit board.

20. The rotary knob of claim 1, wherein:

the first signal trace is one of a plurality of signal traces, the plurality of signal traces further comprising a second signal trace and a third signal trace;

the plurality of signal traces are arranged along a plurality of lines on the circuit board, the plurality of lines comprising a first line and a second line;

the first signal trace and the second signal trace are arranged in the first line; and the third signal trace is arranged in the second line.

21. The rotary knob of claim 20, wherein a non-conductive area is further arranged on the circuit board in the first line separating the first signal trace and the second signal trace.

* * * * *